US008508449B2

(12) United States Patent
Broughton et al.

(10) Patent No.: US 8,508,449 B2
(45) Date of Patent: Aug. 13, 2013

(54) ADAPTIVE IMAGE PROCESSING METHOD AND APPARATUS FOR REDUCED COLOUR SHIFT IN LCDS

(75) Inventors: Benjamin John Broughton, Abingdon (GB); Harry Garth Walton, Oxford (GB); Paul Antony Gass, Oxford (GB); Meelis Lootus, Bristol (GB); Charlotte Wendy Michele Borgers, Oxford (GB)

(73) Assignee: Sharp Corporation, Osaka (JP)

( * ) Notice: Subject to any disclaimer, the term of this patent is extended or adjusted under 35 U.S.C. 154(b) by 882 days.

(21) Appl. No.: 12/637,824

(22) Filed: Dec. 15, 2009

(65) Prior Publication Data

US 2010/0156774 A1 Jun. 24, 2010

Related U.S. Application Data

(60) Provisional application No. 61/138,594, filed on Dec. 18, 2008.

(51) Int. Cl.
*G09G 3/36* (2006.01)

(52) U.S. Cl.
USPC ..... 345/88; 345/50; 345/77; 345/589; 345/600; 345/601

(58) Field of Classification Search
None
See application file for complete search history.

(56) References Cited

U.S. PATENT DOCUMENTS

| | | | | |
|---|---|---|---|---|
| 4,840,460 | A | 6/1989 | Bernot et al. | |
| 5,847,688 | A | 12/1998 | Ohi et al. | |
| 6,067,063 | A | 5/2000 | Kim et al. | |
| 6,801,220 | B2 | 10/2004 | Greier et al. | |
| 7,079,214 | B2 | 7/2006 | Shimoshikiryo | |
| 2002/0135598 | A1 * | 9/2002 | Tezuka et al. | 345/613 |
| 2004/0239698 | A1 | 12/2004 | Kamada et al. | |
| 2005/0219186 | A1 | 10/2005 | Kamada et al. | |
| 2006/0132509 | A1 * | 6/2006 | Choe et al. | 345/690 |
| 2007/0040780 | A1 * | 2/2007 | Gass et al. | 345/87 |
| 2008/0030660 | A1 * | 2/2008 | Roth et al. | 349/106 |
| 2008/0118176 | A1 * | 5/2008 | Li et al. | 382/274 |
| 2008/0158203 | A1 | 7/2008 | Irie et al. | |
| 2009/0073192 | A1 | 3/2009 | Kobayashi | |

FOREIGN PATENT DOCUMENTS

| | | |
|---|---|---|
| EP | 1 553 553 | 7/2005 |
| GB | 0804022.2 | 8/2009 |
| GB | 0819179.3 | 4/2010 |
| JP | 2004-302270 A | 10/2004 |

(Continued)

OTHER PUBLICATIONS

International Search Report for corresponding International Application No. PCT/JP2009/071360 mailed Apr. 6, 2010.

(Continued)

*Primary Examiner* — Lixi C Simpson
(74) *Attorney, Agent, or Firm* — Renner, Otto, Boisselle & Sklar, LLP

(57) ABSTRACT

A method and apparatus is provided for reducing color shift in relation to viewing angle in an LCD. The method includes receiving a plurality of pixel data constituting an image, each pixel data including a plurality of sub-pixel color components having respective data values; for each of the pixel data, comparing the sub-pixel color component data values included therein; and based on the comparison, modifying the sub-pixel color component data values included in the pixel data to reduce color shift when displayed on the LCD.

26 Claims, 21 Drawing Sheets

(56) References Cited

FOREIGN PATENT DOCUMENTS

| | | | |
|---|---|---|---|
| JP | 2008-191269 | A | 8/2008 |
| WO | 2006/049245 | A1 | 5/2006 |
| WO | 2008/091005 | A1 | 7/2008 |

OTHER PUBLICATIONS

Office Action issued on Mar. 27, 2013 for related U.S. Appl. No. 13/139,766.

* cited by examiner

Figure 7

| Colour Component with highest data level | R | G | B |
|---|---|---|---|
| LUT 1 selected if: | h-m ≤ 11 | h-m ≤ 2 | h-m ≤ 9 |
| LUT 2 selected if: | 12 ≤ h-m ≤ 23 | 3 ≤ h-m ≤ 5 | 10 ≤ h-m ≤ 19 |
| LUT 3 selected if: | 24 ≤ h-m ≤ 35 | 6 ≤ h-m ≤ 8 | 20 ≤ h-m ≤ 29 |
| LUT 4 selected if: | 36 ≤ h-m ≤ 47 | 9 ≤ h-m ≤ 11 | 30 ≤ h-m ≤ 39 |
| LUT 5 selected if: | 48 ≤ h-m ≤ 59 | 12 ≤ h-m ≤ 14 | 40 ≤ h-m ≤ 49 |
| LUT 6 selected if: | 60 ≤ h-m ≤ 71 | 15 ≤ h-m ≤ 17 | 50 ≤ h-m ≤ 59 |
| LUT 7 selected if: | 72 ≤ h-m ≤ 83 | 18 ≤ h-m ≤ 20 | 60 ≤ h-m ≤ 69 |
| LUT 8 selected if: | 84 ≤ h-m | 21 ≤ h-m | 70 ≤ h-m |

Figure 18

Example 1: Uniform Data region

| | |
|---|---|
| Pixel (x,y) Data=200 | Pixel (x+1,y) Data=200 |
| Pixel (x,y+1) Data=200 | Pixel (x+1,y+1) Data=200 |

| (data(x,y)+data(x+1,y+1)) - (data(x+1,y)+data(x,y+1)) | = 0 (≤Threshold)

Colour Shift Correction Process modifications may be applied to pixels

Example 2: Diagonalised Data region

| | |
|---|---|
| Pixel (x,y) Data=255 | Pixel (x+1,y) Data=0 |
| Pixel (x,y+1) Data=0 | Pixel (x+1,y+1) Data=255 |

| (data(x,y)+data(x+1,y+1)) - (data(x+1,y)+data(x,y+1)) | = 510 (≥Threshold)

Colour Shift Correction Process modifications prevented

Figure 21

Frame 1

| | | | |
|---|---|---|---|
| B + | D - | B + | D - |
| D - | B + | D - | B + |
| B + | D - | B + | D - |
| D - | B + | D - | B + |

Frame 2

| | | | |
|---|---|---|---|
| B - | B + | D - | D + |
| B + | B - | D + | D - |
| D - | D + | B - | B + |
| D + | D - | B + | B - |

Frame 3

| | | | |
|---|---|---|---|
| D + | B - | D + | B - |
| B - | D + | B - | D + |
| D + | B - | D + | B - |
| B - | D + | B - | D + |

Frame 4

| | | | |
|---|---|---|---|
| D - | D + | B - | B + |
| D + | D - | B + | B - |
| B - | B + | D - | D + |
| B + | B - | D + | D - |

ADAPTIVE IMAGE PROCESSING METHOD AND APPARATUS FOR REDUCED COLOUR SHIFT IN LCDS

CROSS-REFERENCE TO RELATED APPLICATION

This application claims priority under 35 USC §119(e) to U.S. Provisional Application No. 61/138,594 filed on Dec. 18, 2008, the entire disclosure of which is incorporated herein by reference.

TECHNICAL FIELD OF INVENTION

The present invention relates to a method of and apparatus for processing image data for display by a display device.

BACKGROUND OF THE INVENTION

Despite significant advances in liquid crystal display (LCD) technology, resulting in very high performance displays with improved metrics such as display area, brightness, image contrast, resolution, color gamut, bit-depth, response time and wide view performance, color shift with viewing angle remains a problem for many types of LCD.

In order to improve the wide-view performance of LCDs, several technologies have been developed. Displays have been produced with angular compensation films such as the splayed-discotic Wide-View film for Twisted Nematic (TN) displays, multidomained pixels for Vertically Aligned Nematic (VAN) and In-Plane Switching (IPS) mode displays, and improved electrode geometries. These developments have enabled displays with no contrast inversion problem at wide viewing angles, i.e. although the absolute brightness of a pixel may change with viewing angle, a pixel which is switched to have an on-axis brightness higher than another pixel will remain brighter at all viewing angles, and vice versa. However, the amount of variation in brightness of a pixel with viewing angle is still a function of the on-axis brightness of the pixel in most types of LCD. This has the effect that in a color display comprising an array of pixels, each of which is composed of a plurality of color sub-pixels, such as red, green and blue sub-pixels in an RGB stripe display for example, if the pixel is displaying a color consisting of different brightness values of the three color components, these different brightness values can shift by a different amount with viewing angle, resulting in a shift in the perceived color.

Again, several technologies have been developed to mitigate this effect. The most effective of these utilise a split sub-pixel architecture, whereby each color sub-pixel in the display consists of two or more regions. In order to produce a given brightness overall to the viewer positioned along the normal to the plane of the display (on-axis), these are made to produce individually a different brightness, one brighter than the other, such that the average brightness of the two regions on-axis is the desired overall brightness, and the shift in brightness with viewing angle of each portion is different so the averaged shift of the two combined is less pronounced than each taken individually.

This method is known as partial spatial dither or digital halftoning, and can be implemented using a capacitive potential divider between the regions of the split sub-pixel, as described in U.S. Pat. No. 4,840,460, and US 20050219186A1, or it can be implemented by using an additional source line per color sub-pixel, such that each of the two regions of the sub pixel receives an independently controlled signal voltage when they are activated by a common gate line. This second implementation is described in U.S. Pat. No. 6,067,063, and the two general approaches are summarized, and optimised relationships between the voltages applied to the brighter and darker regions of the sub-pixel for reduced color shift given in U.S. Pat. No. 7,079,214.

It is not necessary to have a split sub-pixel architecture to implement such a method. The technique can effectively be implemented in software, or in the LCD control electronics, and applied to any existing color display by adjusting the brightness of whole color sub-pixels up and down alternately, either in the spatial or temporal domain, to create the same effect at the expense of the effective resolution of the display. Brightness is effectively transferred between the color components of neighbouring pixels, so that no overall change occurs, but the difference in brightness of neighbouring pixels is increased, resulting in an average shift in brightness with viewing angle which is reduced. This is described in U.S. Pat. No. 6,801,220 and U.S. Pat. No. 5,847,688. In U.S. Pat. No. 6,801,220, this is implemented by an image processing method in which the image data input to the LCD is manipulated by means of a Look-Up Table (LUT), so that for each input data level, a pair of output data levels is provided which, when displayed by neighbouring pixels on the LCD, are averaged by the eye of the viewer (assuming sufficient display resolution and viewing distance) to appear the same as if the original input data level were displayed on both pixels. The image processing method therefore alternates spatially across the display which of the pair of output data values is applied to each pixel for a given input data value.

All of the above methods implement a halftoning method, either within each color sub-pixel of the display in the case of the split sub-pixel, or within groups of neighbouring sub-pixels in the case of the image processing methods, in which the relationship between the brightness of the sub-pixels or sub-pixel regions which are combining to provide the required average brightness is fixed, either by the ratio of the capacitive potential divider applied between the regions, or by the use of a single LUT to output the brighter and darker data levels for each input data levels for all pixels in the display.

As a result of this fixed relationship, both of the above approaches in pixel hardware and display software or control electronics suffer from the limitation that in order to optimally reduce the color shift with viewing angle of the display, the effective pixel brightness observed by the on-axis viewer has to be composed of two or more regions of different brightness, for all but the off state (zero voltage applied to all regions). Both regions, either the plurality of regions within a split color sub-pixel, or neighbouring whole color sub-pixels which have been subject to a transfer of luminance within local groups, therefore cannot be fully bright without compromising the effectiveness of the method in reducing the color shift.

An LCD display generally consists of several component parts including:

1. A backlighting unit to supply even, wide angle illumination to the panel.
2. Control electronics to receive digital image data and output analogue signal voltages for each pixel, as well as timing pulses and a common voltage for the counter electrode of all pixels. A schematic of the standard layout of an LCD control electronics is shown in FIG. 1 (see, E. Lueder, *Liquid Crystal Displays*, Wiley and Sons Ltd., 2001).
3. A liquid crystal (LC) panel, for displaying an image by spatial light modulation, includes two opposing glass substrates, onto one of which is disposed an array of pixel electrodes and an active matrix array to direct the electronic signals, received from the control electronics, to the pixel electrodes. Onto the other substrate is usually disposed a uniform common electrode and color filter array film. Between the glass substrates is contained a liquid crystal layer of given thickness, usually 2-6 μm, which may be aligned by the presence of an alignment layer on the inner surfaces of the glass substrates. The glass substrates will generally be placed between crossed polarising films and other optical compensation films to cause the electrically induced alignment changes within each pixel region of the LC layer to produce the desired optical modulation of light from the backlight unit and ambient surroundings, and thereby generate the image.

Generally the LCD Control Electronics (referred to herein also as control electronics) will be configured specifically to the electro-optical characteristics of the LC panel so as to output signal voltages which are dependent on the input image data in such a way as to optimise the perceived quality of the displayed image, i.e. resolution, contrast, brightness, response time, etc., for the principal viewer, observing from a direction normal to the display surface (on-axis). The relationship between the input image data value for a given pixel and the observed luminance resulting from the display (gamma curve) is determined by the combined effect of the data-value to signal voltage mapping of the display driver, and the signal voltage to luminance response of the LC panel.

The LC panel will generally be configured with multiple LC domains per pixel and/or passive optical compensation films so as to preserve the display gamma curve as closely as possible to the on-axis response for all viewing angles, thereby providing substantially the same high quality image to a wide viewing region. However, it is the inherent property of liquid crystal displays that their electro-optic response is angularly dependent and the off-axis gamma curve will differ from the on-axis one, and while contrast inversion problems have largely been solved with multidomain pixels and improved compensation films, color shift with angle remains a problem.

For reasons of clarity, the following examples to illustrate this effect and descriptions of the embodiments to reduce it will be directed toward VAN mode LCD displays, with 8 bit per color gradation control. The problem of color shift with angle is not restricted to VAN mode displays or displays of any particular color depth, nor is the applicability of the embodiments described herein, so this should not detract from the scope of the invention, which is applicable to any LCD which exhibits color shift with angle.

FIG. 2 shows the measured angular dependence of the luminance of a multidomained VAN mode LCD in a mobile phone display, at shades of grey from input data level=0 (black) to 255 (white) in steps of 32. FIG. 3(*a*) shows the points of FIG. 2 at 0° and 50° inclination to the right hand side (horizontal in the orientation in which the display is normally observed) plotted against the input data level. The On-Axis curve is known as the display "gamma" curve, being designed to approximately follow the relationship $$\frac{L}{L_{max}} = \left(\frac{D}{D_{max}}\right)^{\gamma}$$

where L is the output luminance, for a given data level D, and γ (gamma) is the power relating the two when each is normalized to their maximum value. The gamma value is typically engineered to be in the region of 2.0 to 2.4, and is approximately 2.3 for the display shown in FIGS. 2 and 3.

FIG. 3(*b*) shows the brightness of the display at 50° inclination as a function of the brightness on-axis, both normalized to their maximum values.

From the figures it can clearly be seen that the typical behaviour for a VAN mode display is for mid-grey levels to appear disproportionately bright when viewed off-axis. This is further illustrated in FIG. 4, which shows the luminance as a function of viewing angle, normalized to the luminance of the data=255 state at each angle, for the same VAN mode display displaying input data=255, 160 and zero. From this figure, it can be seen that if a pixel was input with data=255 to the red color sub-pixel, with data=160 to the green color sub-pixel and with data=0 to the blue color sub-pixel, on-axis, the ratio of normalized luminances is approximately 1:0.35:0 for R:G:B, which would result in an orange colored appearance for the pixel. However, when viewed from 50° inclination, the ratio of color components is approximately 1:0.77:0.03, which would result in a yellow appearance for the pixel. This is the cause of the color-shift with viewing angle, and it can be seen that, for VAN mode displays in particular, the degree of color shift is greatest for colors which are composed of one color component near maximum luminance, and one or two color components in the mid-luminance range.

The aim of conventional digital halftoning methods is to reduce this change in relative brightness of the color components of a pixel by replacing sub-pixels which are displaying 50% of maximum luminance with a half sub-pixel region at maximum luminance, and a half sub-pixel region at minimum luminance, in the case of the hardware method, or replace a neighbouring pair of sub-pixels which are set to display 50% of maximum luminance with one at maximum luminance and one at minimum luminance in the case of the software or control electronics methods. A mid-luminance sub-pixel or sub-pixel pair thereby becomes effectively a maximum luminance sub-pixel of half the standard emitting area, so the luminance of the sub-pixel or sub-pixel pair is half that of the maximum luminance state at all viewing angles, so color shift is avoided.

Obviously, only a pair of sub-pixels at exactly the average of maximum and minimum luminance can be replaced with one at maximum and one at minimum luminance without affecting the combined appearance of the pair to the on-axis viewer. Pixels with other values can be replaced by one pixel at minimum or maximum luminance, and the other at the some luminance to make up the required overall average. For this reason, U.S. Pat. No. 6,801,220 provides the LUT illustrated in FIG. 5(*a*) to relate pairs of pixels with a maximal difference between the pixels in the pair and an average luminance equal to the average luminance of two pixels of the same input data level, for all input data levels on a display with a gamma equal to 2.2.

The equivalent of FIG. 3(*b*) for a display in which the pixel data values have been altered according to the LUT of FIG. 5(*a*), is shown in FIG. 5(*b*). As can be seen from this figure, the normalized luminance at 50° inclination now no longer differs from the normalized luminance on-axis for pixels at 50% of maximum luminance. Color pixels comprising combinations of color components at minimum, 50% and maximum luminance will now have no color shift with viewing angle. The normalized luminance at 50° inclination does not coincide with the normalized luminance on-axis for pixels set to display luminance values other than these however, particularly for pixels set to display 25% or 75% of maximum luminance, so when displaying colors with one or more color components at these levels, color shift will still be apparent. Also, as the reduction in color shift is significantly greater using the LUT method described above for pixels with a color component at 50% luminance on-axis then the same pixel with the same color component moved to 75% luminance, images which have smoothly varying color across the display e.g. one color component changing from 50% to 75% luminance, will not appear to vary smoothly off axis, as not only is the color changing across the display, the degree of correction of color shift also changes, producing an exaggerated effect which can be very off-putting to the viewer. In order to resolve this problem, U.S. Pat. No. 6,801,220 suggests a modified LUT in which pairs of pixels with the same input data level are replaced with one higher and one lower data level pixel, but with the difference in the adjusted pixels no longer maximised. This will reduce the effectiveness of the color shift reduction effect however.

For these reasons, in many LCD television displays, where accurate picture reproduction over a very wide range of viewing angles is an important feature, all input data levels, except for data=0, are displayed using a split sub-pixel with different brightness on each sub-pixel half. This allows all colors except black to be composed of color components consisting of two different brightness regions, and consequently two different viewing angle variations which are averaged to produce a more uniform response. Color shift is thereby reduced; the maximum transmission (brightness) of the display is also consequently reduced.

FIG. 6(*a*) shows the measured luminance of the two halves of a split sub-pixel in a commercially available VAN mode LCD television. As can be seen in the Figure, the darker sub-pixel half reaches approximately 65% of the luminance of the brighter sub-pixel half at input data=255. This results in the display having a brightness of 82.5% of its maximum in order to preserve colors at wide viewing angles. FIG. 6(*b*) shows the corresponding normalized luminance at a viewing angle of 50° inclination against the normalized on-axis luminance for the television as measured. As can be seen, the off-axis luminance is still not completely linear with on-axis luminance, so color will still shift, but less than an unmodified display, and more uniformly with input data level than the result of the LUT method of FIG. 5, so the exaggerated off-axis color changes associated with that method do not occur.

It is therefore clear that a requirement exists for an optimised method of reducing the color shift with viewing angle in LCD displays which provides the required degree of color shift reduction, with minimum loss of peak brightness of the display.

SUMMARY OF THE INVENTION

There is provided a method of processing image data for display by an LCD device which includes receiving pixel data constituting an image, performing a measurement on the relative data values of the color components of each pixel or group of pixels, altering the data values of the color components by an amount depending on the result of the previous measurement step and in a direction dependent on the spatial position of the pixel in the image, and outputting the modified image data for display on the LCD.

In accordance with an aspect of the invention, a method is provided for reducing color shift in relation to viewing angle in an LCD. The method includes receiving a plurality of pixel data constituting an image, each pixel data including a plurality of sub-pixel color components having respective data values; for each of the pixel data, comparing the sub-pixel color component data values included therein; and based on the comparison, modifying the sub-pixel color component data values included in the pixel data to reduce color shift when displayed on the LCD.

According to a particular aspect, the modifying step includes mapping each data value of at least one of the sub-pixel color components into at least two modified data values which are displayed on the LCD in multiplexed manner, and which exhibit a combined luminance to an on-axis viewer that is equal or proportional to that of the at least one of the sub-pixel color component data value.

According to another aspect, pixels in the LCD include sub-pixels having a split sub-pixel structure, and the at least two modified data values are displayed on the LCD in spatially multiplexed manner via the split-sub pixel structure.

According to still another aspect, the at least two modified data values are displayed on the LCD in at least one of spatial and temporal multiplexed manner in cooperation with neighbouring pixels.

According to another aspect, the at least two modified data values are displayed on the LCD in at least one of spatial and temporal multiplexed manner in conjunction with frame inversion.

According to yet another aspect, the mapping step takes into account different liquid crystal response times for the LCD for different transitions.

In accordance with another aspect, the at least two modified data values are displayed on the LCD via the corresponding pixel in time multiplexed manner.

According to another aspect, the mapping step includes utilizing at least one look up table to map sub-pixel color component data values to corresponding pairs of the modified data values.

In still another aspect, the mapping step comprises utilizing a look up table selected from among a plurality of different look up tables as a function of the comparison step.

With respect to another aspect, the plurality of look up tables each produce different pairs of modified data values for a given sub-pixel color component data value, where the different pairs of modified data values result in approximately the same average luminance when displayed to an on-axis observer.

According to another aspect, the mapping step comprises utilizing a single look up table indexed as a function of the comparison step.

In accordance with still another aspect, the greater a difference between the sub-pixels color component data value having the highest data value among the sub-pixel color component data values for a particular pixel data, and the sub-pixel color component data value having a middle data value, the greater a degree of splitting of the modified data values.

According to another aspect, the comparing step includes identifying the sub-pixel color component data value having the highest data value among the sub-pixel color component data values for a particular pixel data, and determining the difference in data value between the sub-pixel color component having highest data value and a sub-pixel color component having a middle data value.

With still another aspect, the comparing step includes calculating a ratio of the sub-pixel component data value having the highest data value and the sub-pixel component data value having a middle data value among the sub-pixel color component data values for a particular pixel data.

According to yet another aspect, the comparing step includes calculating a difference or ratio between the sub-pixel component data value having the highest data value and the sub-pixel component data value having a middle data value and a difference or ratio between the sub-pixel component data value having the highest data value and the sub-pixel component data value having the lowest data value.

In still another aspect, the comparing step includes taking into account the sub-pixel color component data values for neighbouring pixels.

According to another aspect, the modifying of the sub-pixel color component data values included in the pixel data is performed with respect to two or more of the plurality of sub-pixel color components.

According to another aspect, a manner in which the sub-pixel color component data values are modified in the modifying step differs as a function of the particular sub-pixel color component.

In yet another aspect, the method is carried out via computer software.

According to another aspect, the method includes a step of processing the plurality of pixel data to provide privacy viewing with the LCD.

In still another aspect, the sub-pixel color component data values included in the pixel data are modified in a public mode in order to reduce color shift when displayed on the LCD, and the sub-pixel color component data values included in the pixel data are modified in a private mode in order to provide privacy viewing.

In accordance with another aspect, the method includes a step of filtering the plurality of pixel data to detect and modify a feature in the received image to avoid an undesirable display result otherwise caused by the modifying of the sub-pixel color component data values.

In still another aspect, the sub-pixel color component data values included in the pixel data are modified differently based on particular color component.

According to another aspect, the modifying step further includes altering a manner in which the modified sub-pixel color component data values are presented on the LCD to maintain dc balancing.

According to yet another aspect, a method of is provided for creating a lookup table. The method includes populating the lookup table with output pixel data for each of the plurality of groups of input pixel data, the step of populating including determining a set of available on-axis/off-axis luminance points for the display device, considering a line or lines covering the full range of on-axis luminance values and having different respective off-axis luminance characteristics, and selecting a plurality of the available luminance points along each of the lines, the selection being made to reduce an error function which depends at least in part on a distance between the point and the line concerned, and populating the lookup table based on the pixel data required to produce the selected luminance points. In accordance with another aspect, a lookup table created in accordance with such method.

According to another aspect, an apparatus is provided for reducing color shift in relation to viewing angle in an LCD. The apparatus includes an input for receiving a plurality of pixel data constituting an image, each pixel data including a plurality of sub-pixel color components having respective data values; a comparison section which, for each of the pixel data, compares the sub-pixel color component data values included therein; and a modifying section which, based on the comparison, modifies the sub-pixel color component data values included in the pixel data to reduce color shift when displayed on the LCD.

According to another aspect, the modifying section maps each data value of at least one of the sub-pixel color components into at least two modified data values which are displayed on the LCD in multiplexed manner, and which exhibit a combined luminance to an on-axis viewer that is equal or proportional to that of the at least one of the sub-pixel color component data value.

In accordance with another aspect, a computer program stored on a computer-readable medium is provided which, when executed by a computer, carries out a method for reducing color shift in relation to viewing angle in an LCD. The method includes receiving a plurality of pixel data constituting an image, each pixel data including a plurality of sub-pixel color components having respective data values; for each of the pixel data, comparing the sub-pixel color component data values included therein; and based on the comparison, modifying the sub-pixel color component data values included in the pixel data to reduce color shift when displayed on the LCD.

According to another aspect, the modifying step includes mapping each data value of at least one of the sub-pixel color components into at least two modified data values which are displayed on the LCD in multiplexed manner, and which exhibit a combined luminance to an on-axis viewer that is equal or proportional to that of the at least one of the sub-pixel color component data value.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

FIG. 7: Is a table showing an example pixel data modification selection scheme in accordance with an embodiment of the invention.

FIG. 17(*b*) includes a line joining points which may be selected for an LUT in accordance with an exemplary embodiment of the invention.

FIGS. 18 and 19: Illustrate a method for preventing color artifacts due to color correction process in accordance with an exemplary embodiment of the invention.

FIG. 21: Is a chart illustrating a series of spatial patterns for respective frames in accordance with an embodiment of the invention.

DETAILED DESCRIPTION OF THE INVENTION

Figure 1:
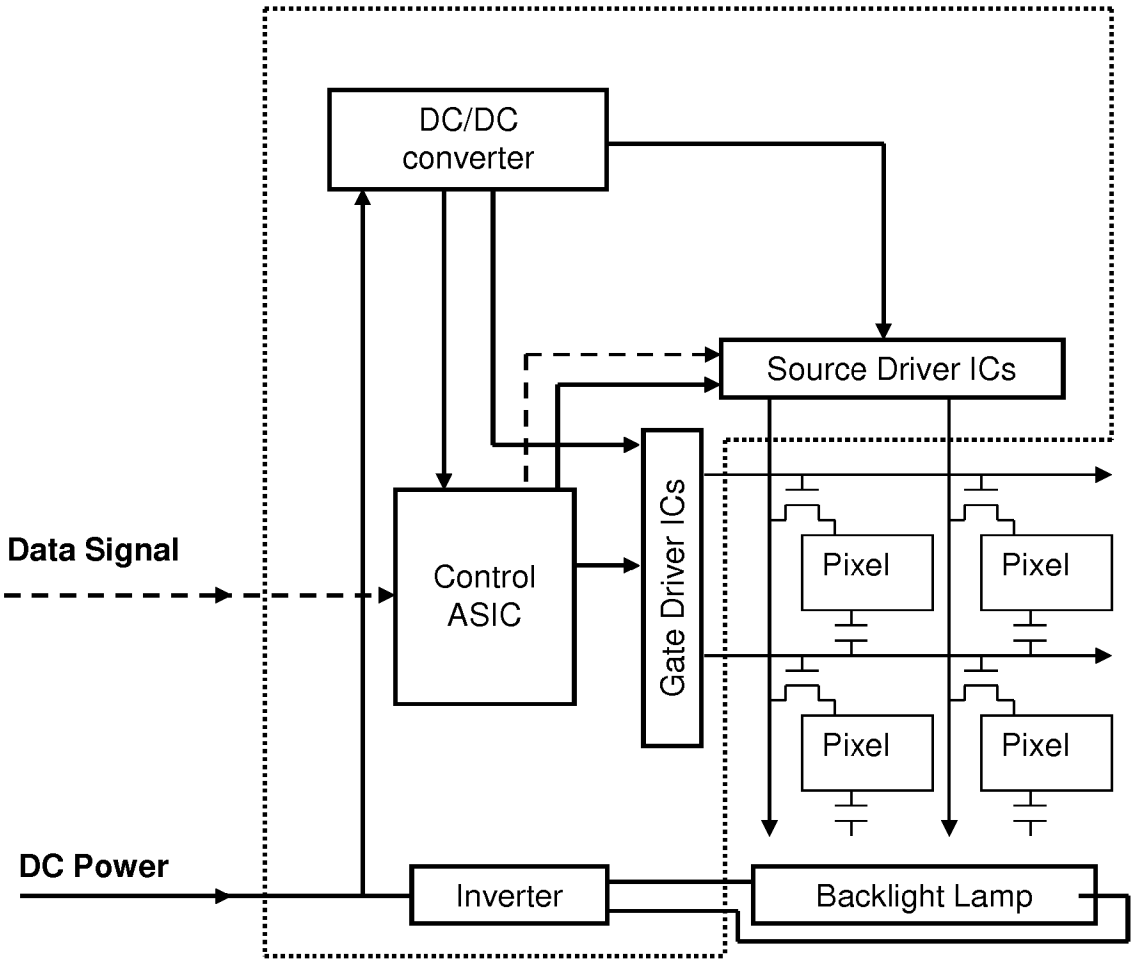
FIG. 1: Is a schematic of the standard layout of the control electronics for a liquid crystal display.
Figure 2:
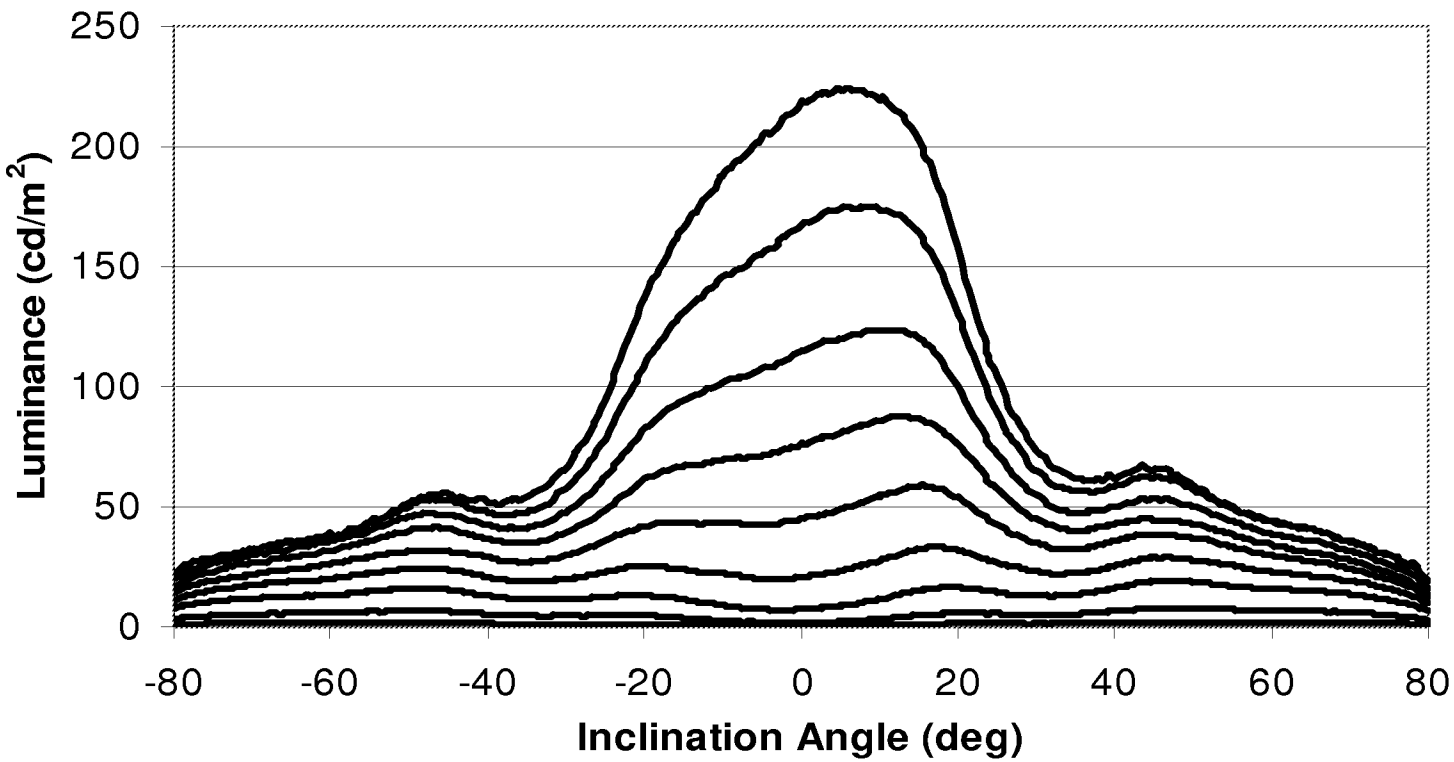
FIG. 2: Is a graph showing the measured angular luminance dependency of a VAN mode LCD at a range of input data levels.

In an exemplary embodiment of a display in accordance with the present invention, the display includes a standard LCD display, an example of which is illustrated in FIG. 1, with modified control electronics.

When such a display is operating in a standard manner, a set of main image data constituting a single image is input to the control electronics in each frame period, typically in the form of a serial bit stream. The control electronics then outputs a set of signal data voltages to the LC panel. Each of these signal voltages is directed by the active matrix array of the LC panel to the corresponding pixel electrode and the resulting collective electro-optical response of the pixels in the LC layer generates the image.

As described above, in displays including a color shift reduction technology, the image data can be modified in the control electronics, the driver circuitry, or the in-pixel electronics so that each pixel of image data received results in multiple different voltages being applied to the multiple different regions of a split sub-pixel, or so that neighbouring pixels or sub-pixels in the image have their data values modified in opposite directions such that the overall effect is that the combined luminance of the sub-pixel regions or sub-pixel pair observed by the on-axis viewer averages to the desired output value.

The present invention provides an improved method of generating the modified data values, or different voltages for different regions within a sub-pixel, via analysis of the data values of the color components of the input pixel data, selection based on the result of that analysis of one of a plurality of available modifications, and application of the selected modification.

Referring to FIG. 1, according to an exemplary embodiment of the invention, the control ASIC is modified to carry out the process described herein in accordance with the present invention, in addition to otherwise conventional control. The control ASIC includes an input for receiving the display input data in the form of a plurality of pixel data constituting an image. Each of the pixel data includes a plurality of sub-pixel color components having respective data values. The control ASIC further include a comparison section which, for each of the pixel data, compares or analyzes the sub-pixel color component data values included therein. Moreover, the control ASIC includes a modifying section which, based on the comparison, modifies the sub-pixel color component data values included in the pixel data as described further herein to reduce color shift when displayed on the LCD. The modified pixel data is in turn provided to the LCD display.

In the exemplary embodiment, the analysis step involves comparison of the input data values of the Red, Green and Blue color components of each input pixel data to determine which of the color components has the highest data value, and to measure the difference in data values between the color component with the highest data value and the component with the second highest data value.

Figure 5:
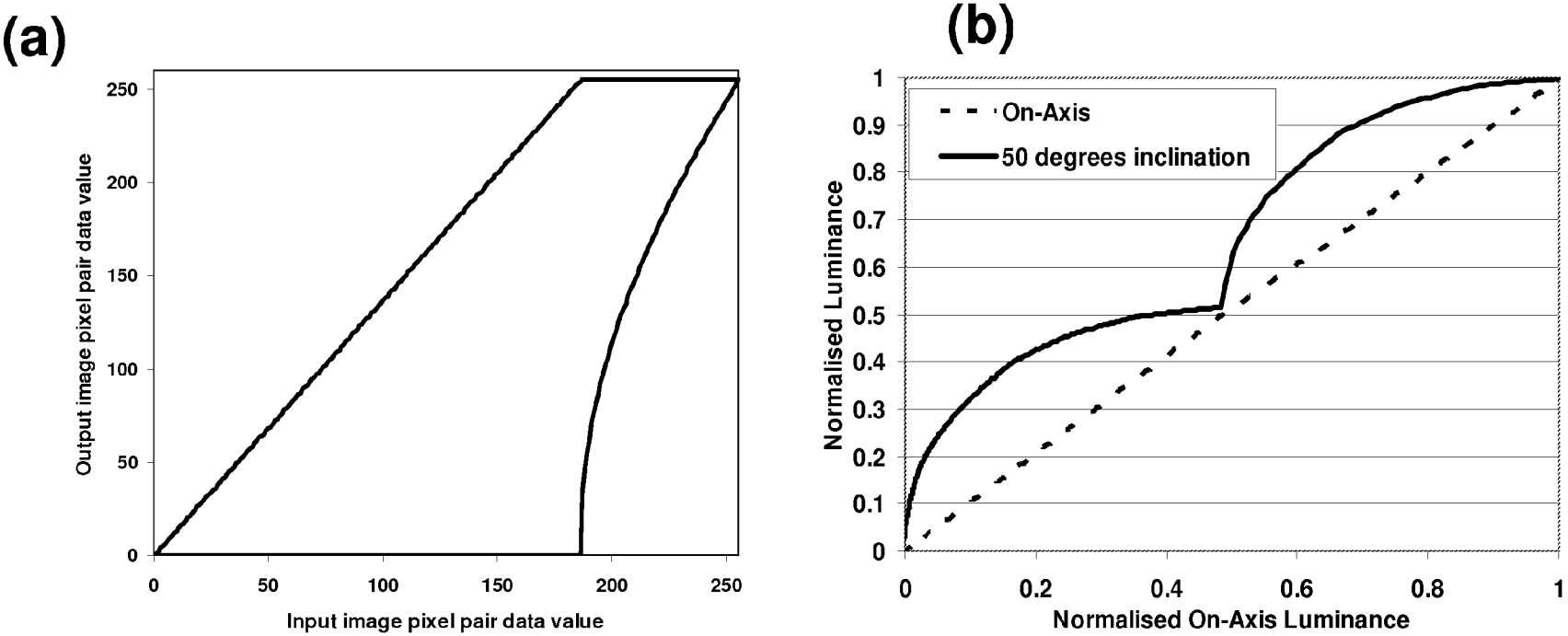
FIGS. 5(*a*) and 5(*b*): Are a pair of graphs showing the output values as a function of input value for a known pixel data modification scheme, and the effect of such modifications on the output luminance of a VAN type display as a function of input data level, at different viewing inclinations.
Figure 6:
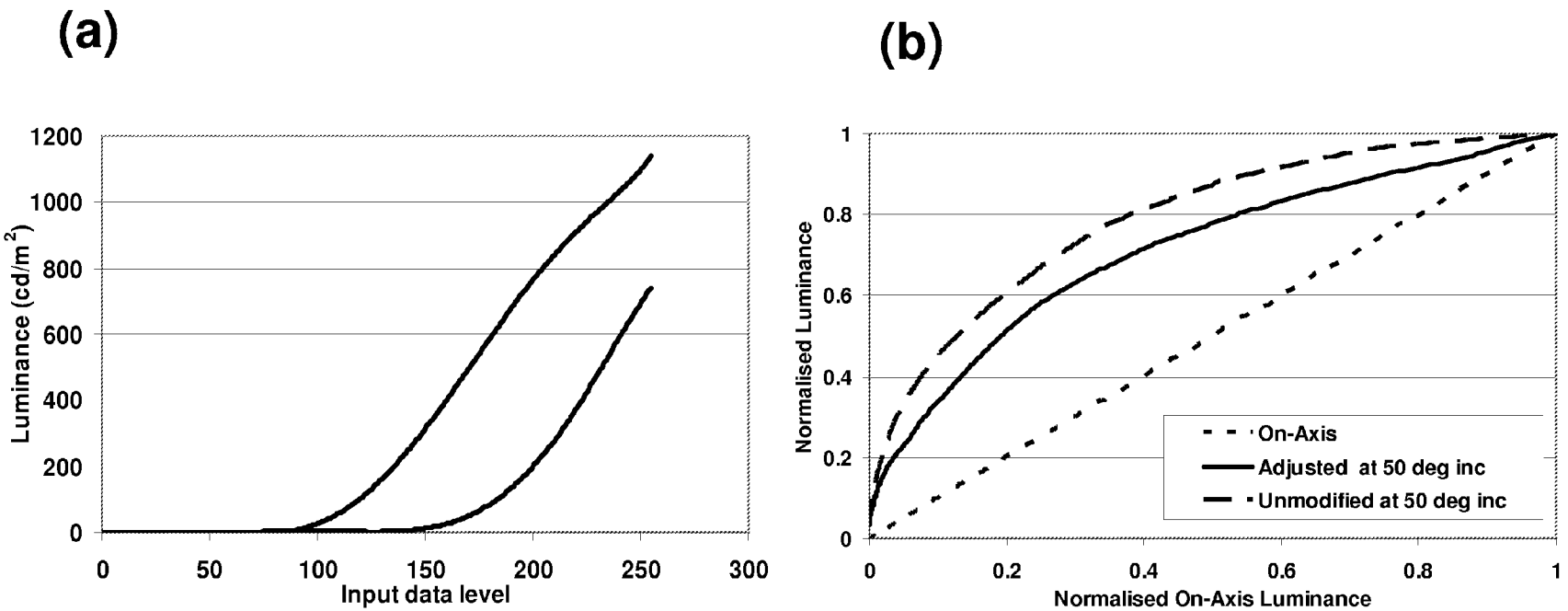
FIGS. 6(*a*) and 6(*b*): Are a pair of graphs showing the output values as a function of input value for a known pixel data modification scheme, and the effect of such modifications on the output luminance of a VAN type display as a function of input data level, at different viewing inclinations.

The selection step then involves selection of one of a number of available LUTs, or output columns in a single expanded LUT, with which to calculate the modified data value to output to the display, based on the result of the previous analysis step. In an embodiment, there are eight LUTs similar to the type illustrated in FIG. 5(*a*), with two possible output values for every input data value. Within each LUT, which output value is selected is dependent on a spatial parameter based on the position of the pixel or sub-pixel being modified in the image to be displayed. For example, to produce a pattern of darkened and brightened pixels or sub-pixels in a checkerboard arrangement, pixels or sub-pixels with a row and column position which are both odd or both even on the display may be modified to take the higher of the two possible output values in the LUT, while pixels or sub-pixels with a row and column position in the image which are odd and even, or even and odd, respectively, may be modified to take the lower of the two possible output values. The brighter-darker pattern of pixels or sub-pixels may be reversed for one or more of the color components of the image in order to reduce the pixel-to pixel luminance change. Indeed, any variant or combination of spatial and/or temporal arrangement of higher and lower adjusted pixels values which allows the on-axis viewer to observe the image comfortably without apparent degradation may be employed. As each of the LUTs includes two columns each with as many rows as there are input data levels for each color component, e.g. 256 in an 8 bit per color display, the eight LUTs may be combined into a single 16 column LUT.

In the exemplary embodiment, the output values for the color component with the highest data value within the pixel being modified are retrieved from the first LUT. The output values for the color components with the second and lowest data value are also retrieved from an LUT, which one depending on which color component has the highest data level and the difference in data value between the highest color component data value, h, and the middle-valued color component data value, m. An example scheme outlining the selection method for which LUT the output values for the color components with the middle and lower data values are retrieved from is shown in FIG. 7. In this Figure, the difference between the data levels of the color components with the higher and middle data values is shown as h−m, and the range of values of this parameter corresponding to selection of each LUT is given, for instances where red, green or blue is the color component with the highest data value.

In the exemplary embodiment, the different LUTs include pairs of output values calculated, based on the gamma characteristic of the display, so that for any given input value each LUT will produce a pair of output pixels with the same average luminance to the on-axis viewer. The different LUTs consist of different output values with a different maximum difference between the higher and lower output value for each input value.

Figure 8:
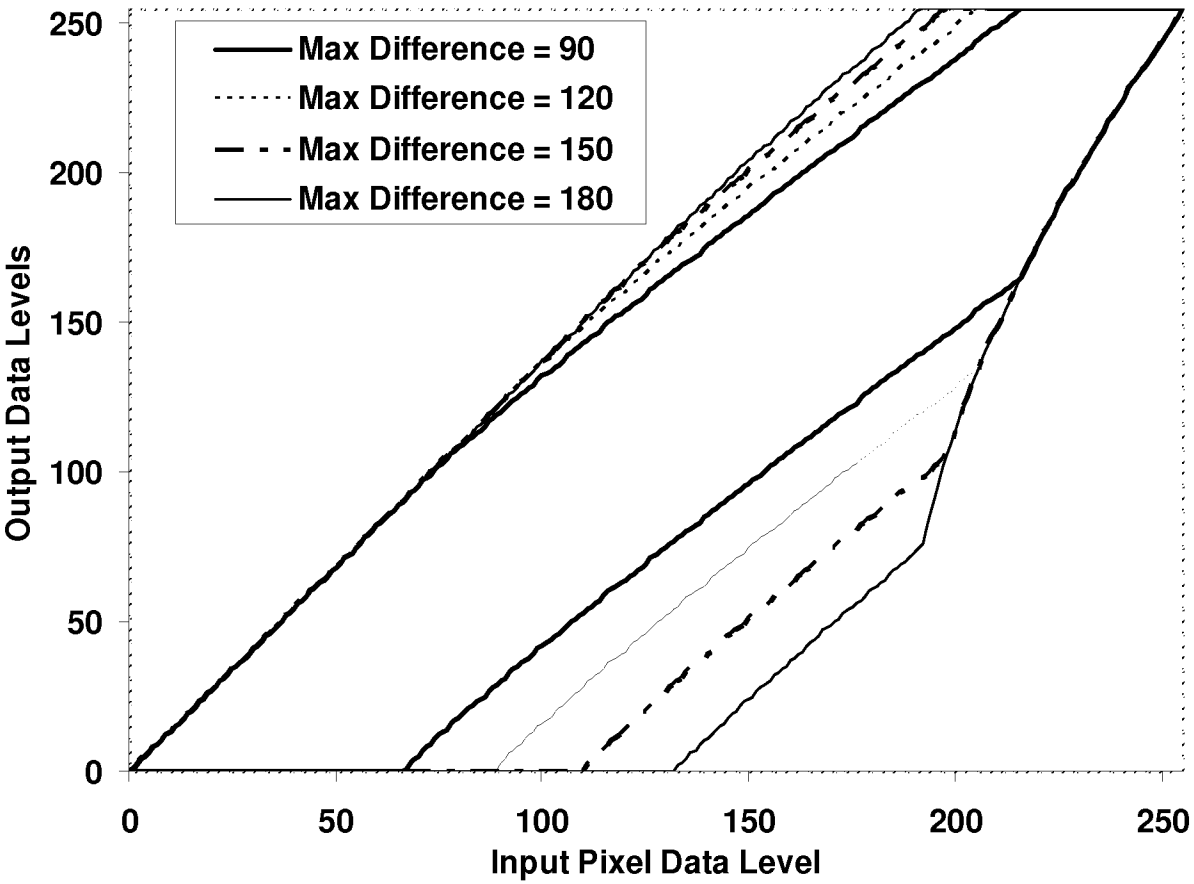
FIG. 8: Is a graph showing an example set of LUT values relating input pixel data values to a plurality of corresponding output pixel data value pairs in accordance with an embodiment of the invention.

An example group of four such LUTs are illustrated in FIG. 8. The LUTs shown are calculated for a display with a gamma value of 2.2, and have maximum differences between their higher and lower output data values for any given input data value of 90, 120, 150 and 180. The two output values for any given input data value in each LUT are calculated such that, although they differ from LUT to LUT, each pair produces a luminance on the output display which averages to the same value in each case, equal to the intended luminance for that input data value on the display. According to an alternative embodiment, each pair of output values may be calculated to have a combined luminance which is proportional, rather than equal, to that of the input data value. For example, it may be desirable to accept some brightness loss (e.g., 5% or 10%) in order to better preserve the color for a wider range of images. In such case, the combined luminance of the output pair may be calculated so as to always be a proportion (e.g., 90% or 95%) of that of the input data value.

In the exemplary embodiment, the 8 LUTs are calculated to have maximum differences in their output values for any given input data value of 90 to 160 inclusive, in steps of 10. This range of LUTs combines with the selection procedure to produce the general outcome that the greater the difference between the data value of the highest color component of a pixel and the middle-valued color component (h−m), the greater the degree of splitting of the output data values relative the input data value that is applied to the lower and middle valued color components. This has the effect that where the data values of the three color components of a pixel are similar, and therefore the variation in luminance with viewing angle of the components is also similar so color shift with viewing angle is not significant, a similar output modification is applied to all the color components. Where there is a greater difference between the color components however, and color shift with viewing angle is therefore a greater problem, a greater degree of modification is applied to the middle and lower valued color components of the pixel, resulting in these components having a lower average off-axis luminance than they would otherwise, and better preserving the intended color.

Figure 4:
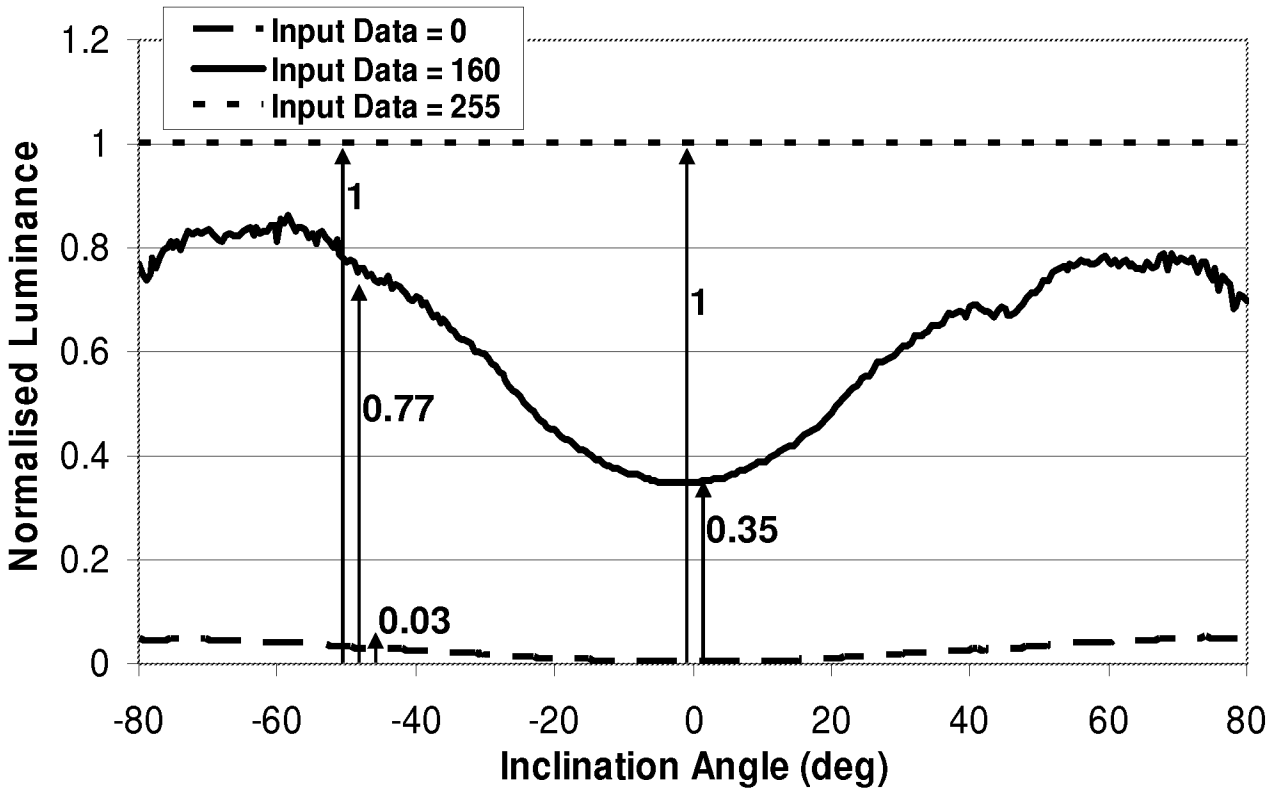
FIG. 4: Is a graph showing the measured angular luminance dependency of a VAN mode LCD at a range of input data levels, normalized to the luminance of the maximum input data level at each angle.
Figure 9:
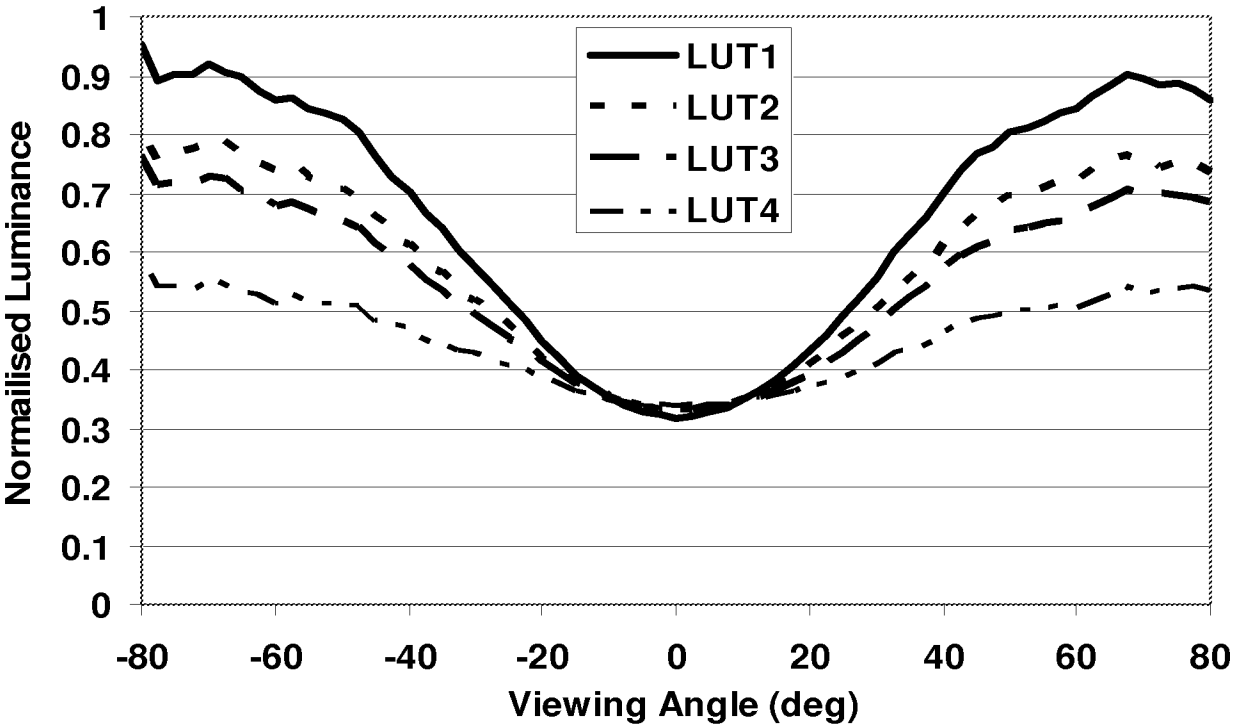
FIG. 9: Is a graph showing the effect of the output result from four different example LUTs on a given input data level on the resulting displayed luminance of the modified pixels as a function of viewing angle in accordance with an embodiment of the invention.

This effect is illustrated in FIG. 9, which shows the measured luminance as a function of viewing angle, normalized to the luminance of the maximum input data value at each angle (as with FIG. 4), for the same mid-grey input data values having been modified according to four of the LUTs of the type shown in FIG. 8. It can be seen that while the different LUTs produce output pixels with approximately equal combined on-axis luminances, the different amount of modification imparted to the pixels in each output pair results in differing off-axis luminances. It is this ability to control the off-axis luminance of output pixel pairs, without affecting the on-axis luminance, which allows the process to adapt to a wide range of input colors and produce an output with optimised off-axis viewing appearance.

Figure 3:
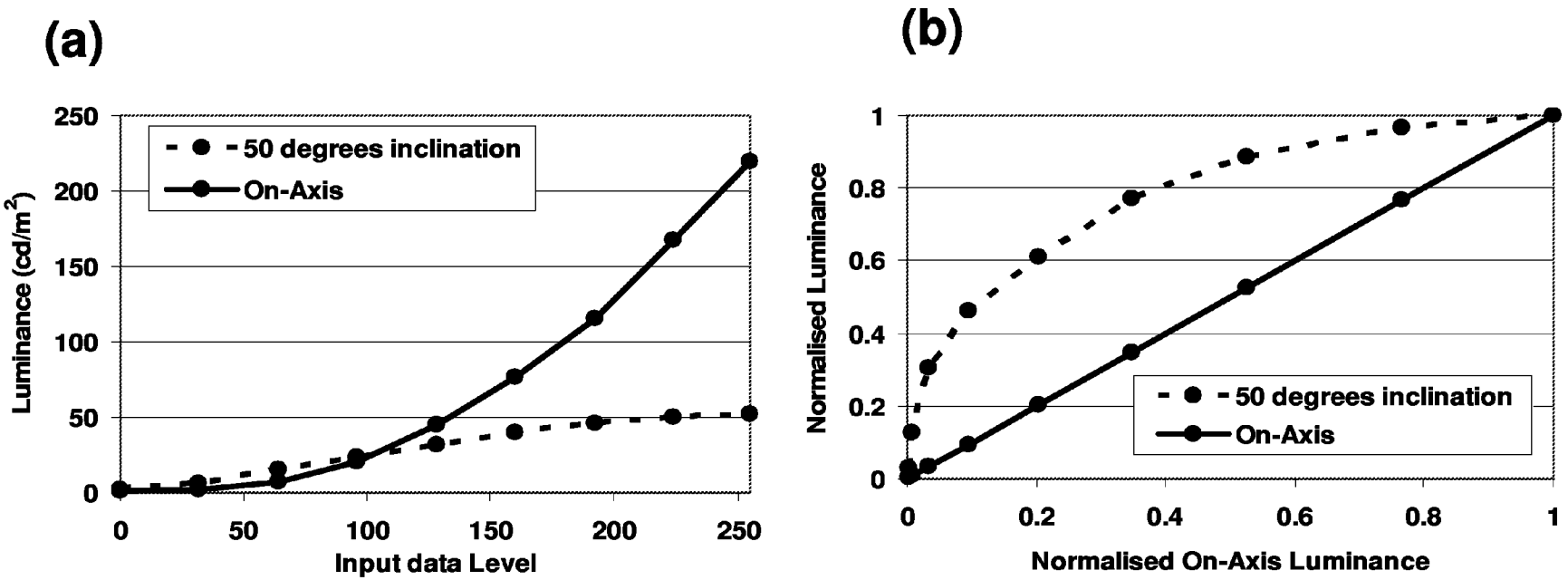
FIGS. 3(*a*) and 3(*b*): Are a pair of graphs showing the data of FIG. 2 at 0° and 50° viewing inclination as a function of input data level and luminance at 0° viewing inclination.
Figure 10:
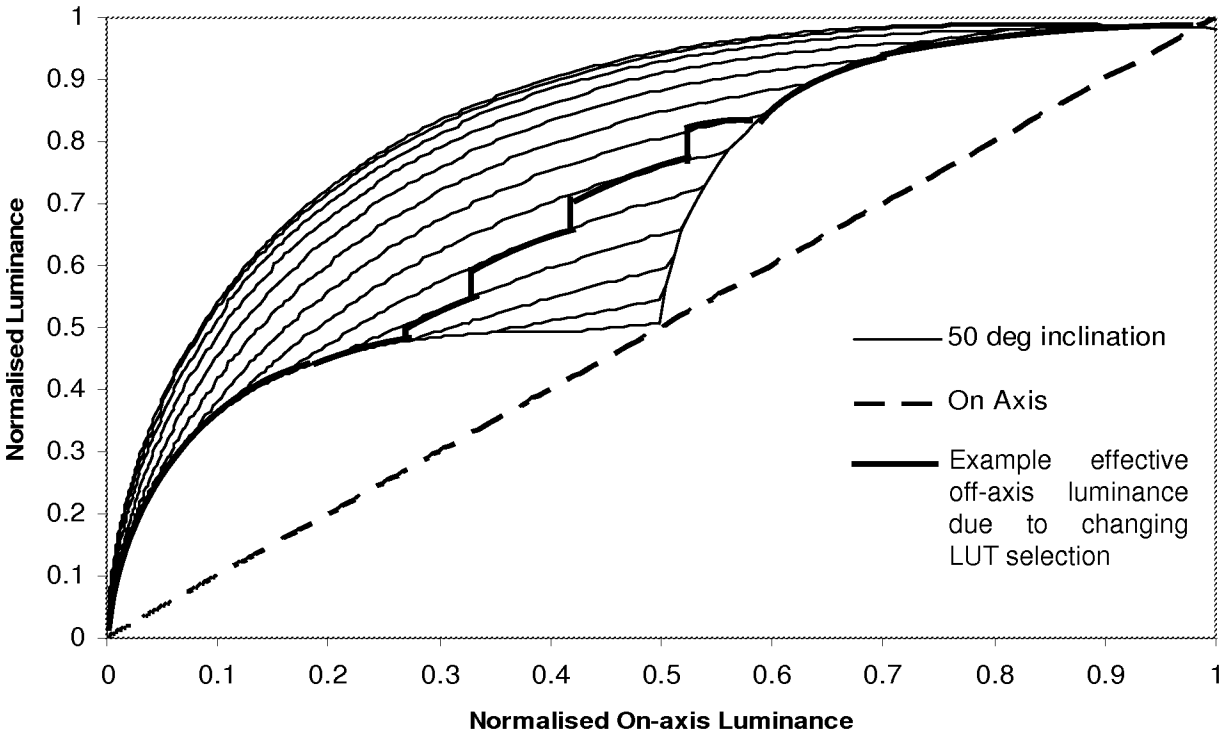
FIG. 10: Is a graph illustrating the range in off-axis luminance values provided for each on-axis luminance value by a plurality of available data level modifications of the type shown in FIG. 8, and how an arbitrary desired effective off-axis to on-axis luminance relationship may be approximated by changing which modification set is applied at different points.

The advantage of having a plurality of LUTs (or the equivalent thereof) with different degrees of modification to the output values is illustrated in FIG. 10. This figure is equivalent to FIGS. 3(*b*) and 5(*b*), showing the off-axis luminance as a function of on-axis luminance for the LCD display in a range of cases in which the input data values have been modified by different amounts. It can be seen from the figure that the off-axis luminance plots of FIGS. 3(*b*) and 5(*b*), in which the input data values are unmodified and modified by the maximum possible amount respectively, form the boundary of an envelope of possible plots for the off-axis to on-axis luminance relationship. Any arbitrary path through this envelope, i.e. any desired off-axis to on axis luminance relationship, can thereby be approximated by changing which modification set is applied at different points, and "hopping" from plot to plot.

Any off-axis to on-axis luminance relationship within this envelope that is found to optimise the viewing angle performance of the display may be approximated to by selecting which LUT is applied to the input data for different input data values. An example path through the envelope which achieves this, by both remaining as close as possible, and also running as parallel as possible, to the on-axis luminance plot, thereby preserving the on-axis color while avoiding artifacts of the type resulting from the modifications of FIG. 5(*b*), is shown in the figure by the bold line.

Of course, a single LUT may be calculated which incorporates the output values for each input value which result in the off-axis luminance plot described by the bold line in the figure. A key advantage of the present invention is that the analysis step preceding the LUT selection step effectively allows the points at which the output values "hop" from one LUT plot to another to be shifted in dependence on the data values of the other color components in the pixel being modified, providing greatly increased scope for optimising the preservation of a wider range of colors and increased maximum brightness.

Figure 17:
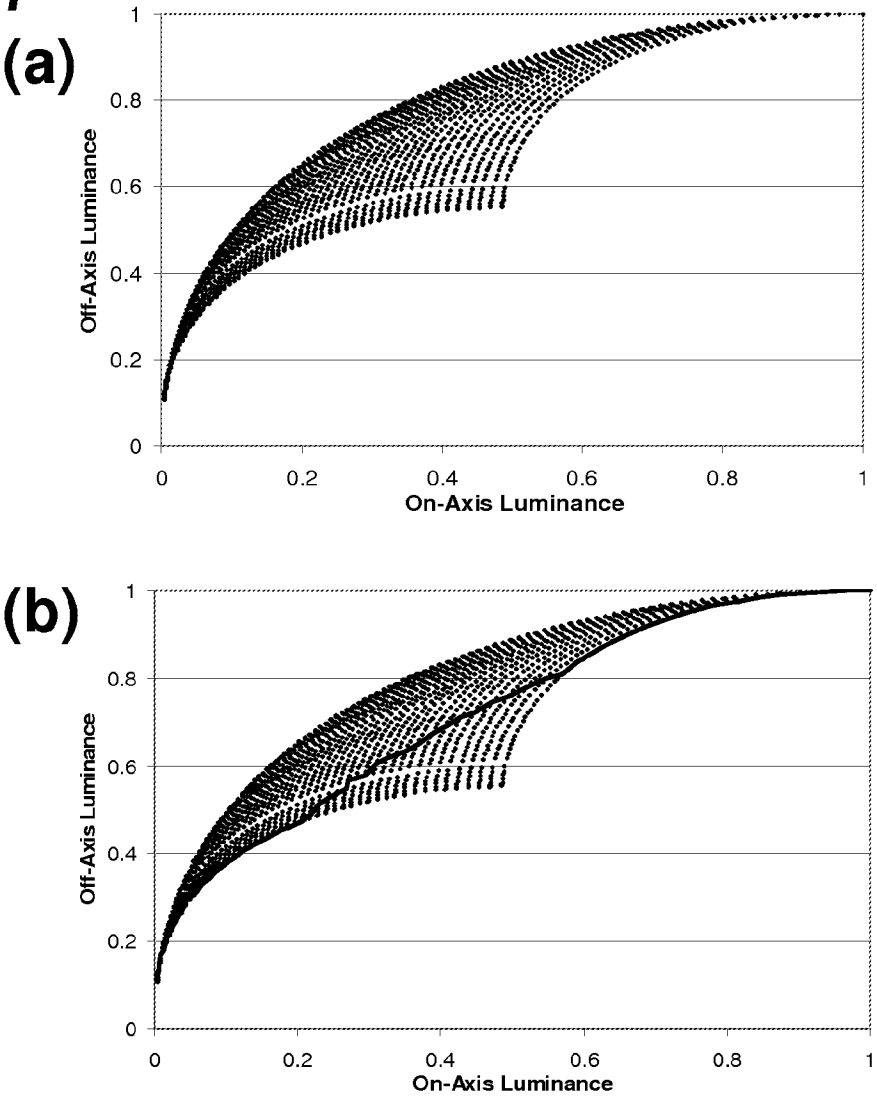
FIGS. 17(*a*) and 17(*b*): Are graphs illustrating off-axis luminance to on-axis luminance for average combined average off-axis and on-axis luminance for all possible combination of data values for a color channel.

If the reduced computing and memory resource required by a method which only uses a single LUT to provide the off-axis to on-axis luminance characteristic shown by the bold line in FIG. 10 is desirable, then the output values of the LUT may be calculated using the following method which is based on that disclosed in the co-pending application GB 0916241.3 for use in a privacy type display: The on-axis and off-axis (e.g. at 50° inclination) luminance of the display may be measured for all input data values, or indeed for a selection of the possible data values and the remainder interpolated, of a particular color channel. From this data, the average combined average off-axis and on-axis luminance for all possible combinations of data values on two pixels of that color may be inferred. If these values are normalized, and each combination plotted as a point in off-axis to on-axis luminance space, the result is as shown in FIG. 17 (*a*).

A series of these points can be selected according to the required on-axis and off-axis luminance for each input data value of the LUT. FIG. 17 (*b*) shows the same population of available average on-axis and off-axis luminance points for the pixel data combinations, with a bold black line joining the points which have been selected for the LUT. In this case, the points have been selected to provide an normalized on-axis luminance for each input data value which is as close to the normalized on-axis luminance which the input data value would itself produce, and a normalized off-axis luminance which is as close as possible to the normalized on-axis luminance, while avoiding any sharp changes in off-axis luminance between points with similar on-axis luminance, which would cause image artifacts to the off-axis viewer. Any off-axis to on-axis luminance trace within the space of available points may be selected but traces of the form shown in FIG. 17(*b*) have been shown to provide good color shift improvement. The output values of the LUT can then be determined as being the combination of two data values which produced each selected point of FIG. 17(*b*). This method may be performed for each color channel of the display, providing a means to achieve good color shift improvement with only one LUT required for each color channel, each LUT consisting of a pair of output data values for each input data value.

After the analysis, LUT selection and data modification steps have been performed on all pixel data values in the input image, the modified image is output from the modified display control electronics to the display. An example process flow diagram for performing the steps described above is given in FIG. 11. The process flow may be implemented via hardware, software stored in computer-readable memory such as read-only memory or the like, or a combination thereof and may be implemented, for example, in the Control ASIC of the control electronics represented in FIG. 1. Those having ordinary skill in the art of computer software and/or hardware design for LCD displays will readily appreciate based on the description provided herein how to provide software and/or hardware to carry out the functions described herein without undue effort or experimentation. Accordingly, further detail as to the particular arrangement has been omitted herein for the sake of brevity.

Figure 11:
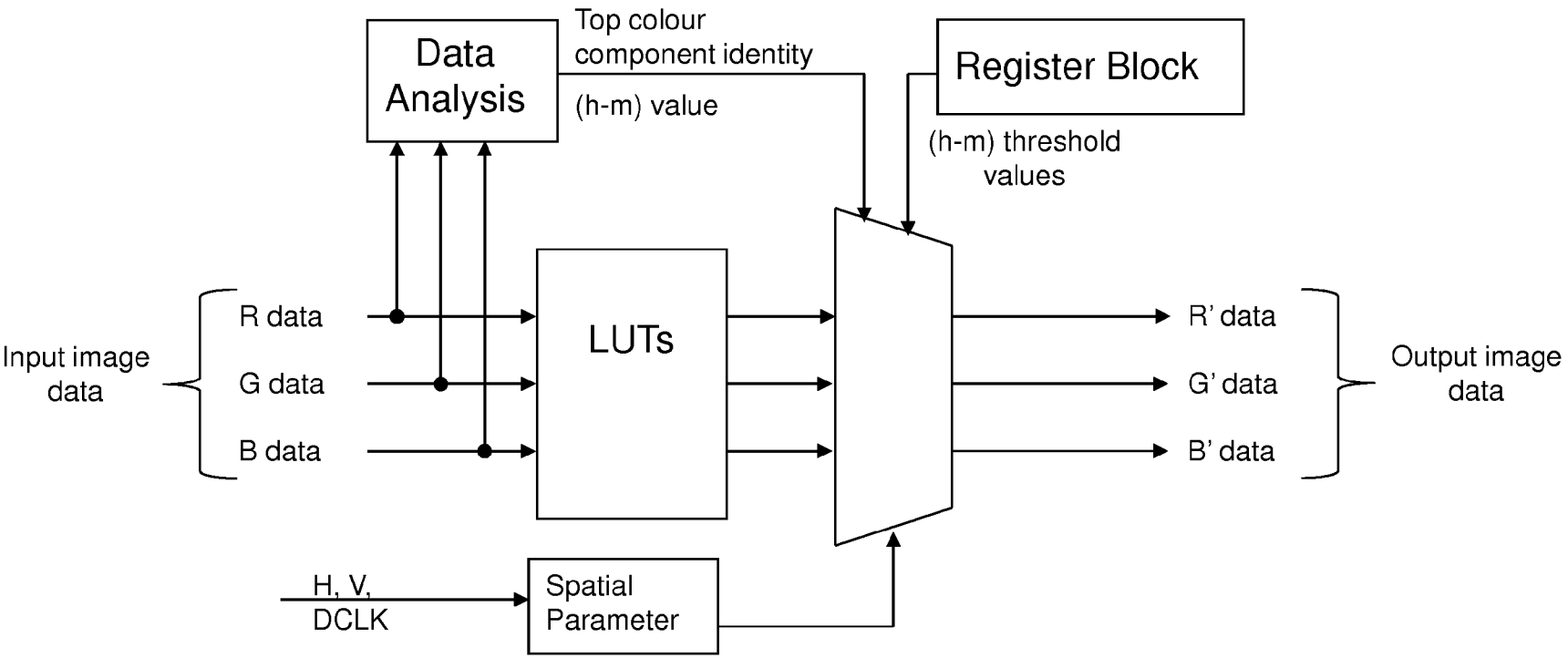
FIG. 11: Is a process flow diagram showing a possible hardware implementation in accordance with an embodiment of the invention.

FIG. 11 exemplifies how initial RGB pixel data constituting an image is received by the Control ASIC, processed in accordance with the invention, and output as modified R'G'B' pixel data. Specifically, the initial RGB data serves as indexing values to the plurality of LUTs discussed herein. The output values from each of the LUTs are input to a multiplexer. The particular LUTs from which output values are selected are determined in part based on the output of a Data Analysis block and Register block. The initial RGB data is analyzed by a Data Analysis block in accordance with the analysis described herein so as to identify the top color component having the highest data level and the (h−m) value. The output of such analysis is provided to the selection input of the multiplexer. The Register block stores the (h−m) threshold values as represented, for example, in FIG. 7. These threshold values are also provided to the selection input of the multiplexer such that, in conjunction with the top color component and (h−m) value, the corresponding LUT(s) which provide the modified R'G'B' image data is selected. Within the selected LUT(s), which particular output value is selected is dependent on a spatial parameter, also provided to a selection input of the multiplexer, based on the position of the pixel or sub-pixel being modified in the image to be displayed. The modified image data from the selected output of the selected LUT(s) is then provided to the source driver ICs and presented to each corresponding pixel.

It has been found that in the selection step, the h−m parameter provides a simple and effective method of determining which LUT will provide the optimum reduction in color shift when the modified values for the middle and lower color component are retrieved from it. However, any other means of analysis of the input pixel values which provides the required differentiation between input colors requiring different output modifications to optimally reduce color shift may be employed.

For example, in further embodiments, the analysis step may include calculating the ratio of the data levels of the highest valued and middle valued color component, e.g. (h/m). The difference or ratio between the highest valued color component and the middle valued color component and the difference or ratio between the highest valued color component and the lowest valued color component, e.g. ((h−m)+(h−l)) may be used. A calculation of the color co-ordinates of the pixel in a standard color space such as the CIE 1931 or 1976 color spaces, based on the data values of the red, green and blue color components, may be performed and the result used in the LUT selection step.

It also may be the case that including information from neighbouring pixels, as well as the pixel currently being modified in the analysis step provides an increased capability to determine the optimum modification to be applied to each color component. In this case the analysis step could sample a one-dimensional or two-dimensional window or kernel of pixels around the pixel currently being modified. The influence of neighbouring pixel values on the parameter used to select which modification is applied to the color components of the pixel may be weighted according the position of the neighbouring pixels relative to the pixel being modified in the image.

In further embodiments, rather than retrieving output data valued for the highest values color component from one LUT and using the analysis step to select an LUT with which to retrieve output values for the middle and lowest valued color components, it may be beneficial to use the analysis step to select different output modifications for all of the color components separately, or any other two of the three components together.

It has also been found that calculating the values to populate the multiple LUTs based on specifying pairs of pixels with the same combined resulting luminance, but different maximum difference between the pixels in the pair (as illustrated in FIG. 8) provides an effective means of controlling the off-axis average luminance, and therefore color, of pairs of pixels, while allowing transitions in the output image between regions which have been produced by the application of different LUT modifications which are not visible either on-axis or off-axis. The capability to apply different modifications to different regions of an image without the boundaries between regions becoming noticeable to the viewer is a key aspect of the invention.

The use of eight LUTs with the maximum difference between output data value pairs increasing by 10 data points in each LUT from 1 to 8 provides a wide enough range of possible output data values with different maximum differences between the pair to prevent color shift problems in most input colors, while ensuring that the jump in maximum output pair difference on going from one LUT to another results in a change in off-axis luminance (the "hop" from plot to plot illustrated by the bold line in FIG. 10) which is not so large as to become visible. However, different applications will have different requirements and it may be that more LUTs, with finer changes in output pair difference, are required at the expense of increased memory requirement, or vice versa.

In order to reduce the number of possible output data modifications required to prevent color shift problem for most input colors, and thereby reduce the memory requirements of the process, in further embodiments, the LUTs are populated with output values which are calculated to have a reduced maximum brightness in the output image. The LUT values can be calculated such that pairs of output pixels have a combined average luminance when displayed of 90% or 95% of the luminance of a pair of unmodified pixels of the same input data value, or any other value which provides the required compromise between maximum display brightness and range of input colors which can be modified to prevent color shift with a set memory requirement. In this case, the average luminance of a pair of output pixels or sub-pixels resulting from a pair in input pixels with the same data value no longer equals the resulting luminance of the input data value, but the average luminance of the output pairs for the same input value of all the available LUTs will still be equal, so the only effect on the observed output image will be an uniform change in brightness compared to an unmodified image.

Figure 12:
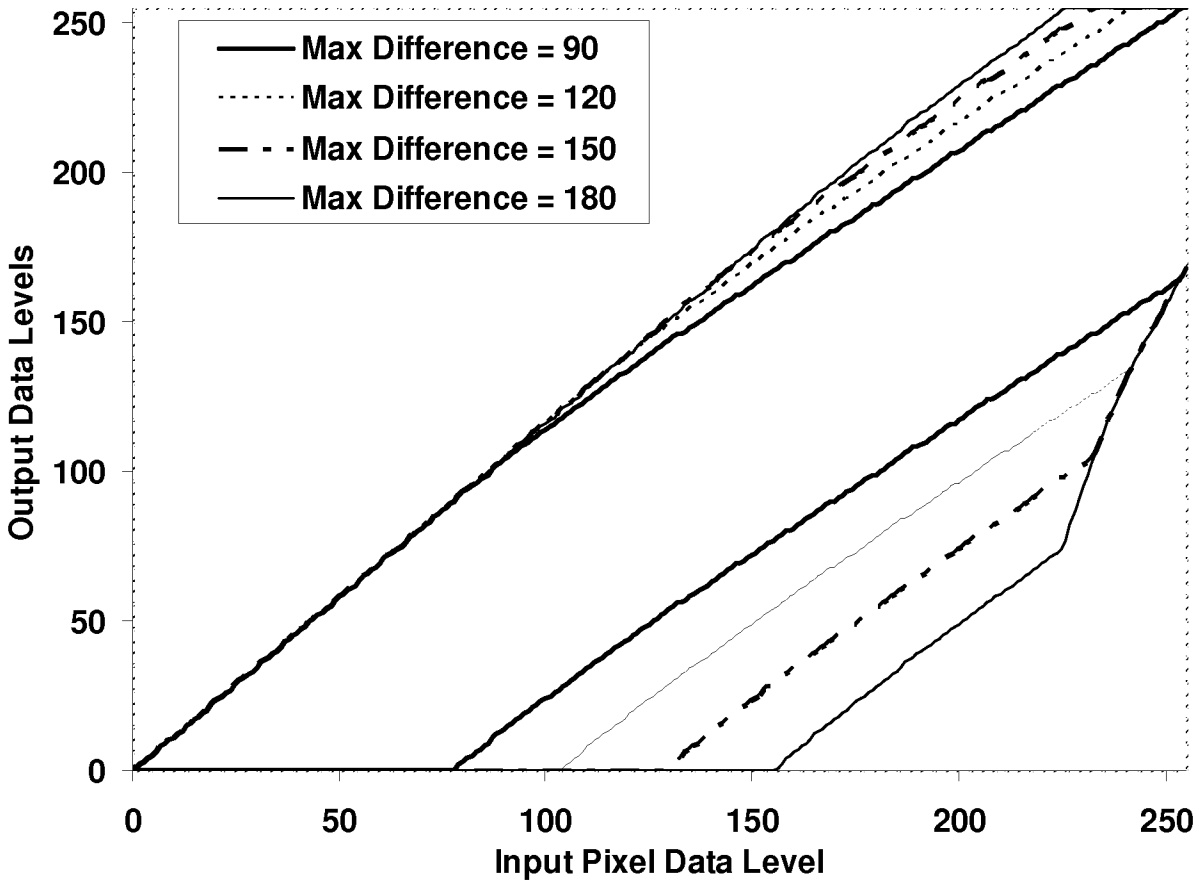
FIG. 12: Is a graph showing a further example set of LUT values relating input pixel data values to a plurality of corresponding output pixel data value pairs in accordance with an embodiment of the invention.

FIG. 12 shows a set of LUTs calculated to have the same maximum differences between output pair pixel values as those in FIG. 8, and the same effective output gamma value of 2.2, but with 70% of maximum brightness. As can be seen, reducing the maximum brightness allows the number of input data values which require one of the output data value pair to have the maximum output value (255) to be reduced. This increases the number of possible input values which result in an output pixel pair with the maximum difference between the output data values for that LUT. This increases the range of input colors for which each LUT is effective, reducing the number of LUTs required for all input colors.

In still further embodiments, rather than having a single set of modifications in a range of LUTs which output data values are retrieved from for all the color components, an individual set of LUTs may be calculated for each of the color components, to take into account differences in the gamma characteristic of each color component in the display.

Figure 13:
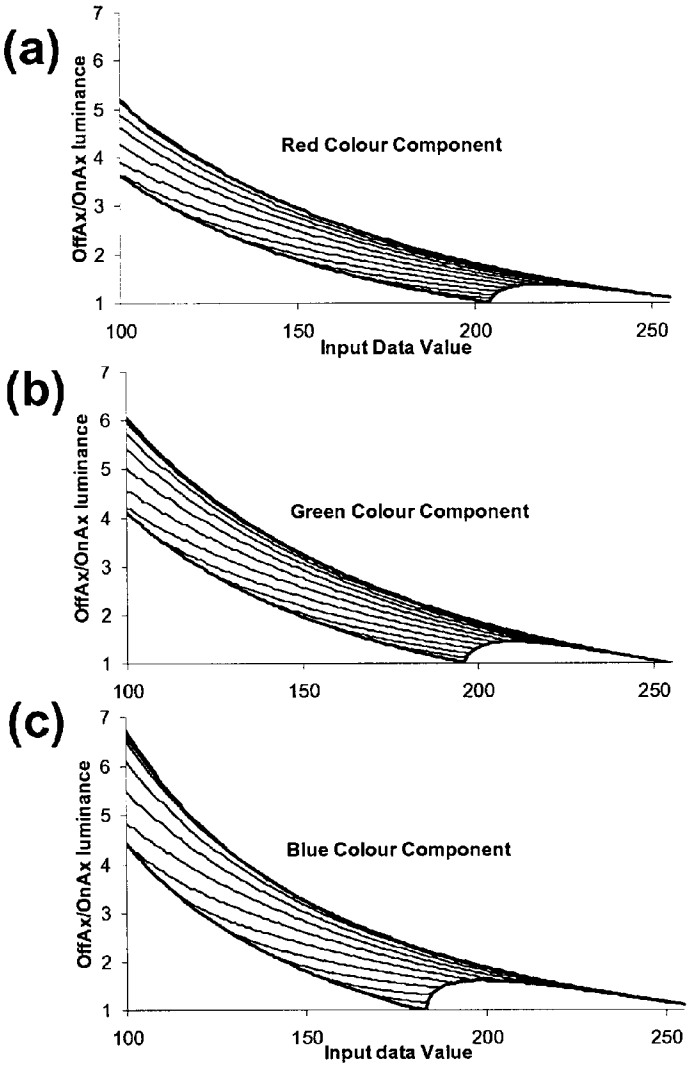
FIGS. 13(*a*), 13(*b*) and 13(*c*): Is a set of graphs showing the range of off-axis to on-axis luminance ratios provided, for each of a range of input data levels, by a set of modifications of the type shown in FIG. 8, for the different color components in a VAN mode LCD.

Indeed, in order to preserve the color of any given pixel with viewing angle as closely as possible, the input data values for the color components of each pixel in the image may be modified by different amounts so that the ratio of on-axis to off-axis luminance for each color component is equalized. This method of processing is illustrated in FIG. 13, which shows the ratio of luminance value off-axis (50° inclination) to on-axis, normalized to the maximum value at each viewing angle, for a range of input data levels, and a plurality of possible data modifications of the type illustrated in FIG. 8. These are shown for the red (a), green (b) and blue (c) color components of a VAN type LCD. As the figure shows, for any given input data level, the plurality of possible modifications provides a range of available ratios of off-axis luminance to on-axis luminance. This range is largest for input data values below that which results in 50% of maximum luminance on the display.

In a still further embodiment, the spatial parameter defining which of the two output values of the selected LUT is used for each input value is reversed each frame period to provide both spatial and temporal alternation of the imposed bright-dark pixel pattern, and the output values of the LUT are calculated so as to take into account the switching speed of the liquid crystal display.

In this way, the bright-dark spatial checker pattern is imposed in the image within each frame, but the checker pattern is inverted with each frame change. To the observer, the image of each frame appears identical due to the spatial averaging of the eye making it impossible to discern which of a pair of pixels has been made brighter or darker within a given frame. The observed luminance change of the image as a whole from frame to frame is therefore negligible, so apparent flicker is minimised even at relatively slow frame rates such as 60 Hz. The key advantage of this frame inversion drive method is that although the macroscopic appearance of each frame, for a static input image, is identical, each pixel is made to change in brightness from frame to frame so as to provide an average luminance over time equal to the desired luminance corresponding to the input data value to that pixel. Therefore, although within each frame a resolution loss is incurred due to the data modifications applied imposing the bright-dark checker pattern, over a period of two frames or more, each individual pixel provides the correct average luminance, so no apparent resolution loss is incurred.

Figure 14:
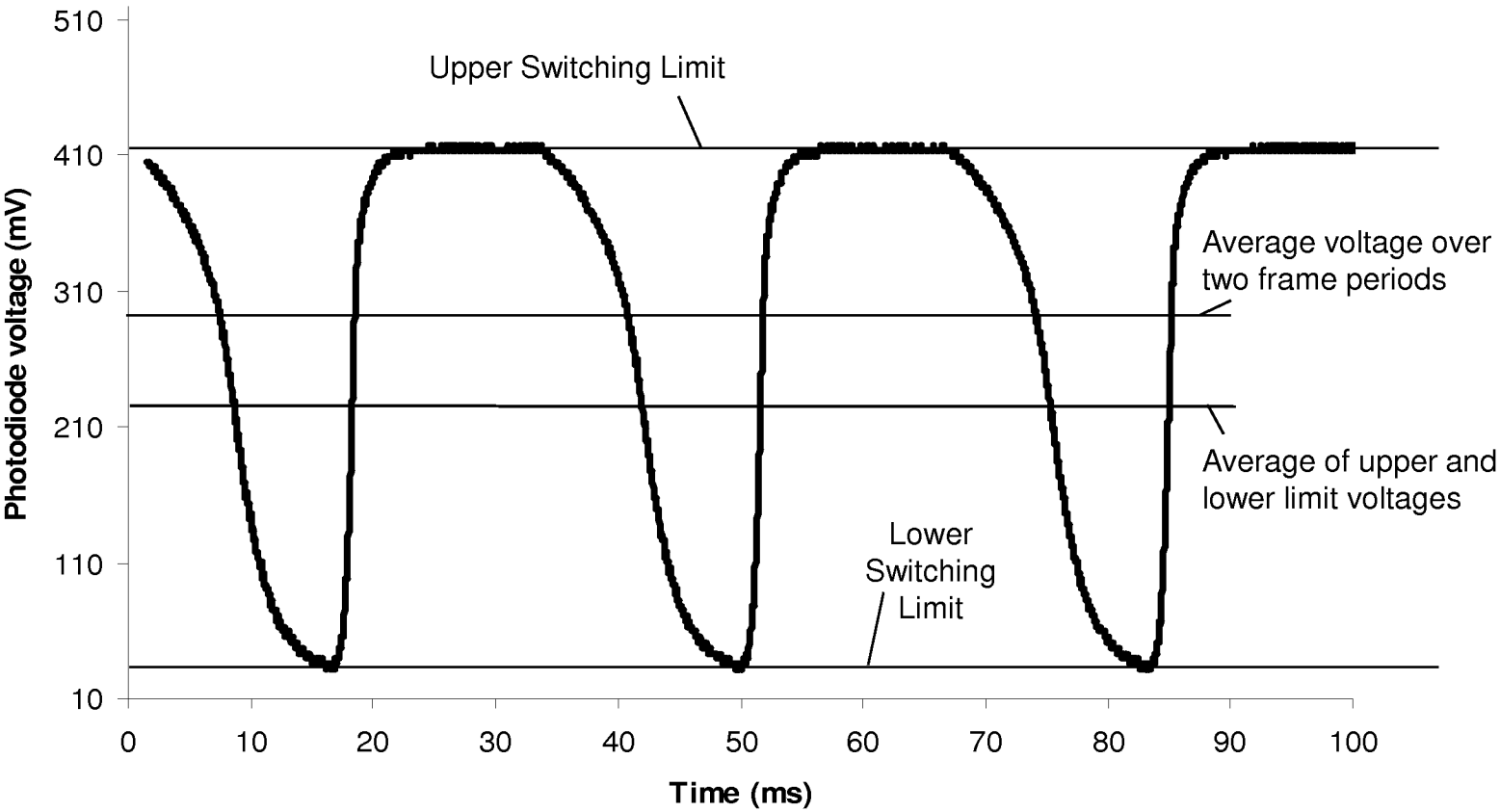
FIG. 14: Is a graph illustrating a photodiode response to a 60 Hz display switching between two data levels each frame.

However, the limited switching speed of the LC material will mean the resultant average luminance of a pixel over the two frame period cycle may not be equal to the average luminance of the bright and the dark state the pixel is switching between when held static over time. This is illustrated in FIG. 14, which shows the photodiode response to a 60 Hz display switching between two data levels each frame. It can be seen from the figure that the display is switching between two brightness states which produce a photodiode voltage of 35 mv and 413 mV. If the transition between these two states in both directions was equally fast, the average photodiode response over a two frame time period would be the simple mean of these values: 224 mV. However, it can also be seen from the figure that the transition to the higher brightness state is quicker than the transition to the lower brightness state, so in fact the measured average photodiode response over the two frame period is 299 mV.

It can therefore be seen that in order to calculate a LUT with pairs of output values for each input data value which produce the same average luminance when displayed over a two frame time period as the input data value produces when displayed in a static manner, this transition time mismatch must be taken into account. In typical liquid crystal displays, this mismatch in the up and down transition time between data levels will vary in dependence on both the upper and lower input data level, so in order to calculate the LUT, a direct measurement of the average luminance produced over time, of all combinations of two data values, is desirable. An output pair with a specified absolute difference in data level between the two values of the pair (i.e. splitting amount), and resultant average luminance over time when displayed in the frame inversion manner, equal to that of each input data level when displayed in a static manner, may then be found. Sets of such pairs for all input data levels would then constitute a LUT, sets of which with different splitting amounts equivalent to that shown in FIG. 8 could be produced.

Figure 15:
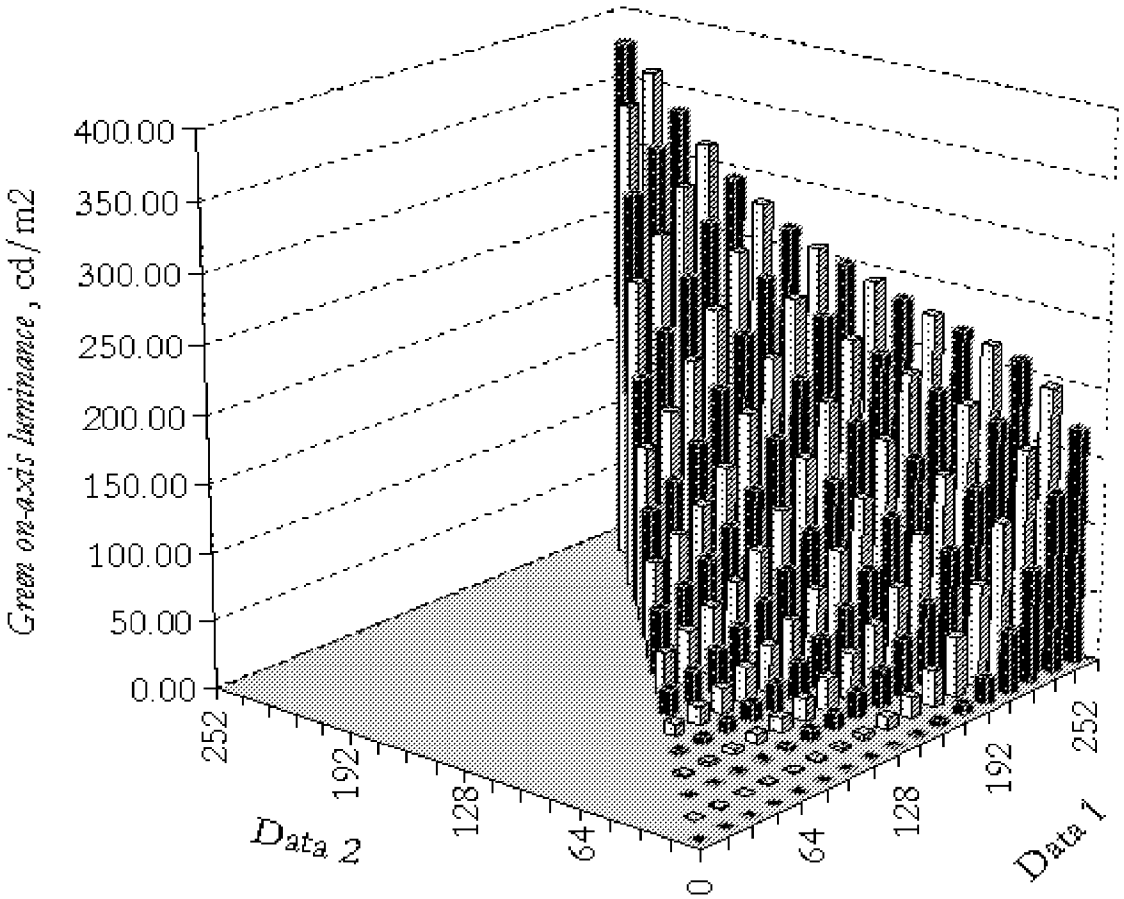
FIG. 15: Is a graph illustrating a set of average luminance measurements for green component pixels values in odd and even frames in steps of 16.

An 8 bit per color channel display has 32,896 such combinations for each color however, which is an impractical number to measure, so the resulting average luminance for a selection of these combinations may be measured and the remainder interpolated form these. FIG. 15 shows the results of a set of such average luminance measurements taken for pixel values in odd and even frames (data 1 and data 2) in steps of 16. Only one half of the graph is populated as the resulting average luminance over a two frame cycle is not dependent on the order in which the data values are displayed in the frames, so the empty half can be assumed to mirror the populated half. From this data a bilinear, or other 2D, interpolation may be performed to obtain values for every pixel combination. These values can then be searched according to the target average luminance for each input image, and given splitting amount, to generate the required LUTs.

Figure 16:
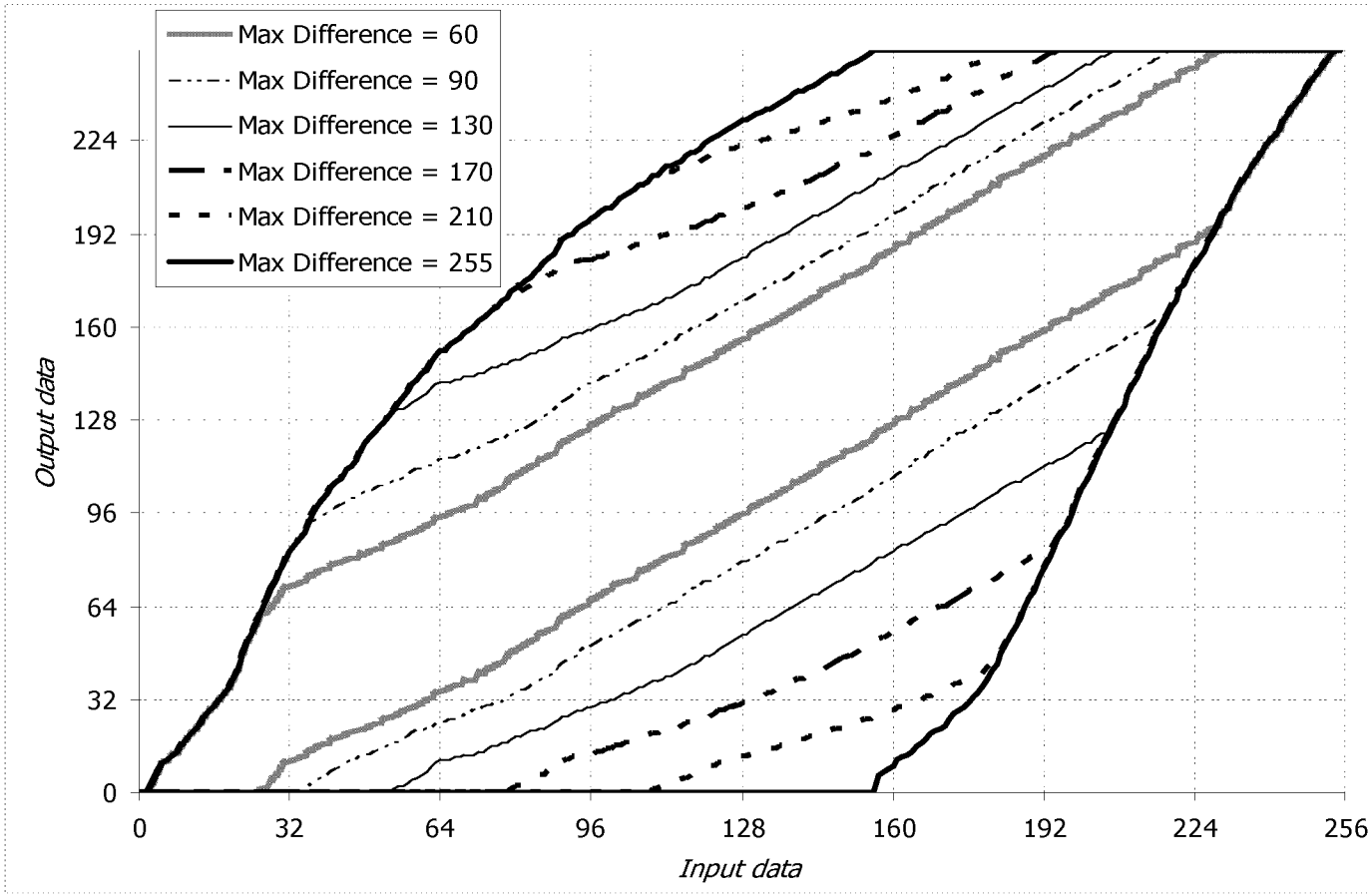
FIG. 16: Is a graph showing an example set of LUT values relating input pixel data values to a plurality of corresponding output pixel data value pairs taking into account transition time mismatch in accordance with an embodiment of the invention.

A plot of an example set of LUTs calculated by this method is given in FIG. 16. As with the LUTs of FIG. 8, each pair of output values produces an equal average luminance to that of the corresponding input data value to the on-axis viewer, but in this case when displayed over time, under the frame inversion driving method. The difference in the functional form of the LUT plots in FIGS. 8 and 16 can be seen, and the unpredictable appearance of the traces in FIG. 16 are the direct consequence of the changing mismatch in up and down transition times between the data values of each pair.

A disadvantage of the frame inversion driving method described above is that the dc balancing of the voltage applied to each pixel over time may be disrupted. The transmission of light through an LCD pixel is dependent only on the magnitude of the voltage applied across that pixel, and is independent of the polarity of the applied voltage. It is standard in LCDs for the polarity of the voltage applied to each pixel to be alternated every frame period. In this way if the displayed image remains constant, there is no net field across each pixel over time. This prevents movement and surface bonding of any ionic contaminants in the LC material which could otherwise cause image sticking or "burn-in". There are many well-known schemes for applying this periodic inversion of the data signal polarity in LCDs, such as frame inversion, line inversion, and dot inversion, but in each of these, for any given pixel in isolation, the polarity is alternated each frame. In the frame inversion driving method described above, the magnitude of the voltage applied to each pixel is alternated between a high and a low value every frame also, even in the case of an unchanging input image. This will mean that the lower of the two output data values for each input value in the LUT will always be applied during frame periods of one polarity, and the higher data value will always be selected for frames of the opposite polarity, and it will no longer be the case that no net field is applied across the LC layer for the display within each pixel over time.

One option for avoiding this problem would be to invert the spatial pattern of which of the two output data values for each input data value is selected every two image frames, rather than every frame. In this way, for a static input image, each pixel is driven with one frame of each signal polarity for each output data value selection, and the dc balancing is fully restored. This method has the drawback that four frames are now required full a full cycle of output data values, and for a typical 60 Hz refresh display, the frequency of the output image cycle is 15 Hz, and flicker may be observed. However, displays with a refresh rate of 120 Hz or 240 Hz are now becoming more common, so this solution will be more applicable. In this case, the measurements taken to produce the data of FIG. 15, which are then used to calculate the LUT values so as to take account of the different LC response times for the different transitions, should be performed so as to measure the average luminance produced over time when the data value on each pixel is alternated every two frames also, so as to maintain the correct LC response compensation in the LUT for the intended frame rate at which the process with be performed.

If a sufficiently high refresh rate to allow this double frame output alternation with no apparent flicker is not possible, the dc balancing may be maintained over a period longer than two frames by periodically shifting the phase of the output data value selection with respect to the signal polarity. This may be done by periodically (for example every second) selecting the same output data value pattern for two frames in a row, before returning to the usual alternation. It may also be achieved by periodically inserting a frame in which the input image is displayed directly with no modification in between frames with the usual alternation of output data value selection pattern.

Another method to allow the dc balancing of the display to be maintained at a low refresh rate, with reduced apparent flicker, may be to switch which of the two output values is selected for half the pixels of the image in odd frame transitions, and for the remaining pixels in the even frame transitions. In this way, each individual pixel is only switched between which of the two output values is applied every two frames, so the dc balancing is maintained, but half the pixels are switched from dark to bright or vice versa every frame, so the apparent rate of change is still at the full refresh rate of the display, minimising the apparent flicker.

A series of arrangements for the spatial pattern of which of the two output values is selected, in which half the pixels of the image are switched in this selection each frame transition, but which maintain an equal number of pixels having the brighter and darker of the two values selected within each frame, thereby maintaining the same overall macroscopic image luminance within each frame, is shown in FIG. 21. With reference to the above figure, each square in the pattern represents a pixel of the image, and a 4×4 pixel potion of the image is represented for each frame. Within each pixel, the B or D label signifies whether the brighter or darker, respectively, of the two available output data values is selected for that pixel in that frame. The + or − label signifies whether the signal voltage across the LC layer in that pixel is of positive or negative polarity respectively for that frame. As can be seen from the figure, the suggested sequence of patterns simultaneously maintains an equal number of pixels in the B and D state within each frame, and over the sequence of four frames ensures that each pixel spends one frame in each of the B+, B−, D+ and D− states, so therefore will be subject to zero net voltage overall, given an unchanging input image. Although the pattern of pixel voltages polarities shown in the example of the figure is that known as "dot inversion", e.g. an alternating checkerboard pattern, a sequence of combination patterns could be found for any dc balancing scheme such as row, column, frame or two-line dot inversion which fulfils the above criteria of an equal balance of B and D state pixels in each frame, and each pixel having each state applied over the four frame period.

In a still further embodiment, for each pixel of image data input to the display, the data values of the individual color components are sampled, and the range of off-axis to on-axis luminance ratios available for each color component are ascertained. If the ranges for each color component overlap, a modification process may be selected for each color component which produces an equal off-axis to on-axis luminance ratio, thereby preserving the color of that pixel with viewing angle exactly. If the ranges do not overlap, a modification may be selected for each component which results in off-axis to on-axis luminance ratios for each component which are as close as possible. In this case increased weighting may be given to the color component with the largest contribution to overall luminance, e.g. green in an RGB pixel display.

It should be noted that while this method allows for an equal off-axis to on-axis luminance ratio to be selected for each color component in a pixel, for a range of input color component data values, the exact value of the ratio will not be the same for all combinations of color component data values for which an equal ratio exists. A compromise exists therefore between preserving the widest range of colors exactly, and preserving the off-axis luminance of different colors with the same overall on-axis luminance. These factors may then be weighted in the color shift correction process according to user preference.

In a still further embodiment, the display used incorporates a split pixel architecture of the type discussed previously, but the color shift correction processing method described is applied in order to transfer luminance between whole pixels of the image, in addition to transferring luminance between two halves of a split sub-pixel.

In this way, the average luminance of a pair of neighbouring pixels can be distributed between four, rather than two emitting areas increasing the control over the off-axis to on-axis luminance ratio of the pixel pair.

It is also the case that the pixel data modification process for reduced color shift as disclosed herein is very similar in process flow and resource requirement to the privacy display technology described in GB patent application 0804022.2. It is therefore the case that the two processes could be combined in a single display device, The present invention therefore includes control electronics or software modified to incorporate both and sharing the computing resource required for each to operate, with the color shift prevention process operating in the public mode of the display and the privacy process operating in the private mode.

As in the case of the similar privacy display processing, there exist for the process of this invention certain particular input image patterns which, when input to the color shift correction process, result in unwanted artifacts in the output image. The process of this invention may then be combined with an input image filtering process, similar to that described in GB patent application 0819179.3, in order to detect and modify image features which may cause problem in the input image.

One drawback of image filtering processes such as that described in GB 0819179.3 is they impart a blurring effect on the image. It has been found that color artifacts resulting from the color shift correction process can be prevented without any blurring or negative effect to the image appearance simply by preventing any modification being performed on the input image in regions where color artifacts would result. For a color shift correction process in which the higher and lower output data values provided for each input data value are selected according to a checkerboard pattern, as in the exemplary embodiment, it is input image regions which are themselves single pixel width diagonal lines, or two pixel pitch checker patterns which cause color artifacts when processed according to the methods of this application. The reasons for this are described in GB 0819179.3.

Figure 19:
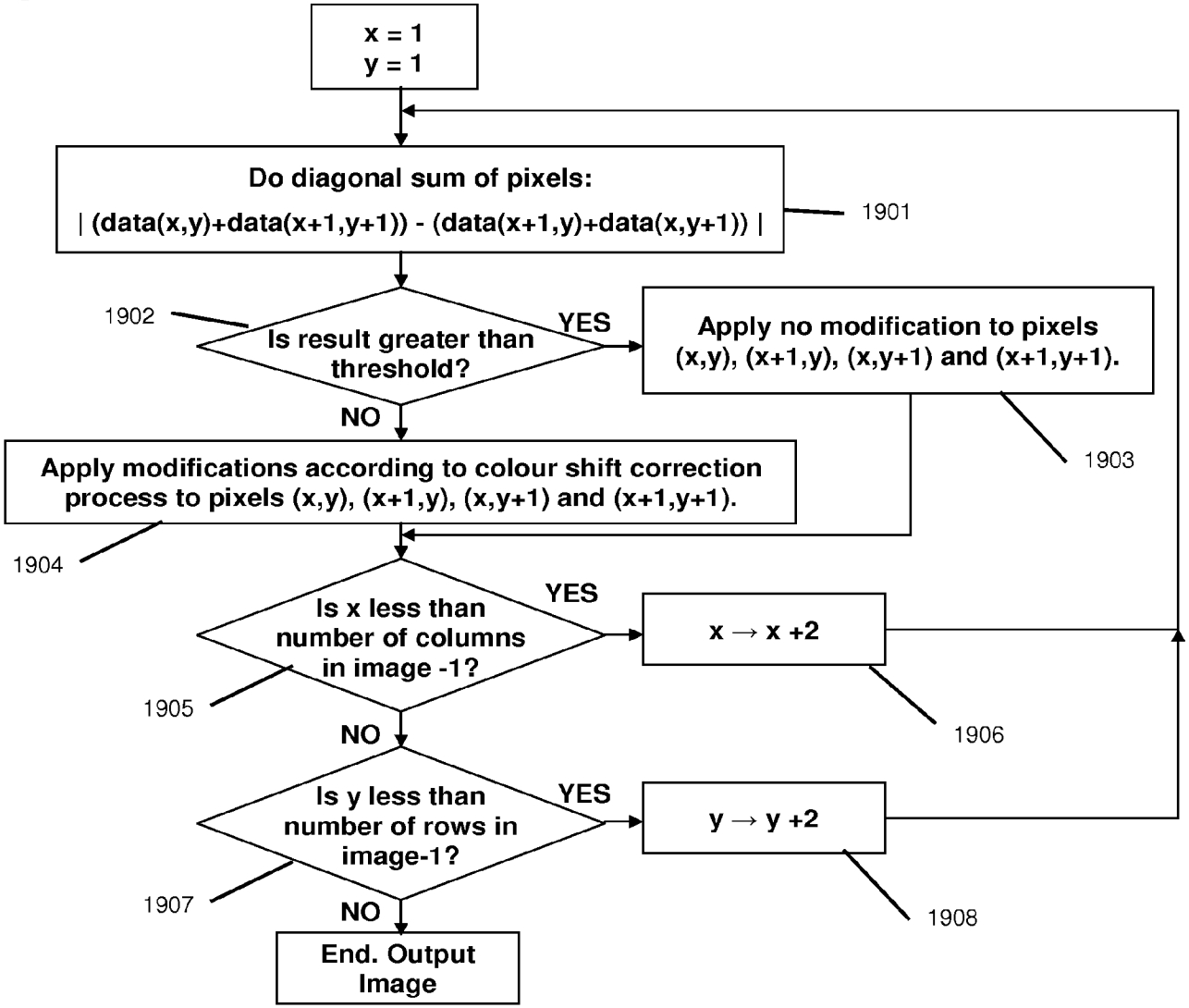

Referring to FIGS. 18 and 19, a simple method to detect such regions and prevent any modification to the input image is therefore to examine each 2×2 pixel region of the image in isolation (S1901) and compare the sum of the top-right and bottom-left pixels in the current region against the sum of the top-left and bottom-right pixels (S1902). If the absolute difference in summed data values is greater than a pre-determined threshold, this can be taken to imply a strong diagonalization in the 2×2 pixel region, in which case modification to the input data values for these four pixels in the image may be prevented (S1903; Example 2 in FIG. 18). Otherwise, if the absolute difference in summed data values is smaller than the pre-determined threshold, color shift correction is applied (S1904; Example 1 in FIG. 18). If this process is repeated for each 2×2 image portion of the image (S1905-S1908), color artifacts due to the color shift correction process can be prevented, and full display resolution is effectively preserved in the image regions where it is required. A threshold value for the absolute difference in diagonal sums of 15 has been found to be sufficient to prevent visible color artifacts in a wide range of sample images. It has also been found that the best image appearance is obtained if this process is applied to each color channel of the image individually, and if an instance in which data modifications should be prevented is found in any of the color channels, modification is prevented for all color components of the relevant pixels of the image.

Figure 20:
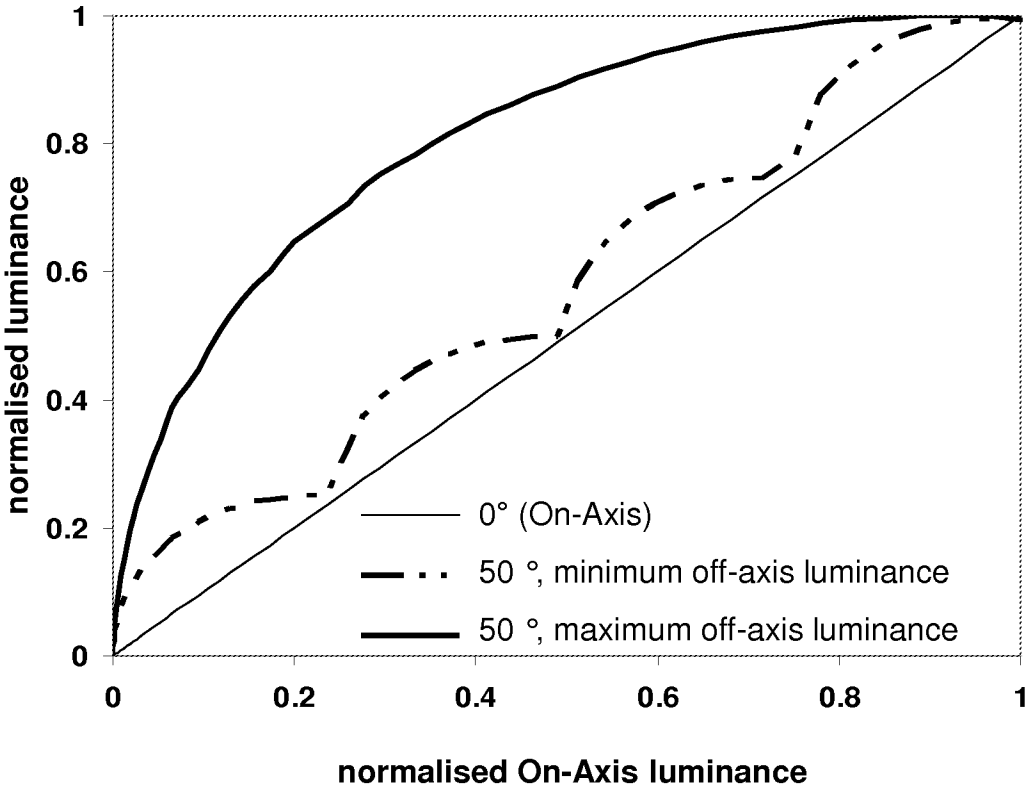
FIG. 20: Is a graph illustrating equivalent available off-axis to on-axis luminance space of FIG. 10 for a process in which four output data values are supplied for each input value.

In a still further embodiment, a color shift correction process according to any of the above descriptions is used, with the difference that for each input data value more than two output data values are supplied. The resultant on-axis and off-axis luminance for a given image region may be the result of the combined on-axis and off-axis luminances of more than two neighbouring pixels, if the possible output values are multiplexed in a spatial manner, or the result of one pixels data values over more than two frame periods, if the output values are multiplexed in a temporal manner. The output values also may be multiplexed both spatially and temporally simultaneously. One advantage of this is that the range of simultaneous off-axis to on-axis luminances which may be achieved for any multiplexed group of pixels in the output image is increased, allowing the degree of color shift improvement to be increased. This is illustrated in FIG. 20, which shows the equivalent available off-axis to on-axis luminance space of FIG. 10 for a process in which four output data values are supplied for each input data value. As can be seen, the increased level of multiplexing allows an average off-axis luminance trace to be produced which is closer to the on-axis luminance at each input value, therefore reproducing the intended on-axis image to off-axis viewers more accurately.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed is:

1. A method for reducing color shift in relation to viewing angle in an LCD, the method comprising:

receiving a plurality of pixel data constituting an image, each pixel data including a plurality of sub-pixel color components having respective data values;

for each of the pixel data, comparing the sub-pixel color component data values included therein; and based on the comparison, modifying the sub-pixel color component data values included in the pixel data, said modification altering a combined off-axis luminance resulting from a group of pixels and leaving an on-axis luminance resulting from the group of pixels substantially unchanged.

2. The method according to claim 1, wherein the modifying step includes mapping each data value of at least one of the sub-pixel color components into at least two modified data values which are displayed on the LCD in multiplexed manner, and which exhibit a combined luminance to an on-axis viewer that is equal or proportional to that of the at least one of the sub-pixel color component data value.

3. The method according to claim 2, wherein pixels in the LCD comprise sub-pixels having a split sub-pixel structure, and the at least two modified data values are displayed on the LCD in spatially multiplexed manner via the split-sub pixel structure.

4. The method according to claim 2, wherein the at least two modified data values are displayed on the LCD in at least one of spatial and temporal multiplexed manner in cooperation with neighbouring pixels.

5. The method according to claim 4, wherein the at least two modified data values are displayed on the LCD in spatial and temporal multiplexed manner in conjunction with frame inversion.

6. The method according to claim 5, wherein the mapping step takes into account different liquid crystal response times for the LCD for different transitions.

7. The method according to claim 2, wherein the at least two modified data values are displayed on the LCD via the corresponding pixel in time multiplexed manner.

8. The method according to claim 2, wherein the mapping step comprises utilizing at least one look up table to map sub-pixel color component data values to corresponding pairs of the modified data values.

9. The method according to claim 8, wherein the mapping step comprises utilizing a look up table selected from among a plurality of different look up tables as a function of the comparison step.

10. The method according to claim 9, wherein the plurality of look up tables each produce different pairs of modified data values for a given sub-pixel color component data value, where the different pairs of modified data values result in approximately the same average luminance when displayed to an on-axis observer.

11. The method according to claim 8, wherein the mapping step comprises utilizing a single look up table indexed as a function of the comparison step.

12. The method according to claim 2, wherein the greater a difference between the sub-pixels color component data value having the highest data value among the sub-pixel color component data values for a particular pixel data, and the sub-pixel color component data value having a middle data value, the greater a degree of splitting of the modified data values.

13. The method according to claim 1, wherein the comparing step comprises identifying the sub-pixel color component data value having the highest data value among the sub-pixel color component data values for a particular pixel data, and determining the difference in data value between the sub-pixel color component having highest data value and a sub-pixel color component having a middle data value.

14. The method according to claim 1, wherein the comparing step comprises calculating a ratio of the sub-pixel component data value having the highest data value and the sub-pixel component data value having a middle data value among the sub-pixel color component data values for a particular pixel data.

15. The method according to claim 1, wherein the comparing step comprises calculating a difference or ratio between the sub-pixel component data value having the highest data value and the sub-pixel component data value having a middle data value and a difference or ratio between the sub-pixel component data value having the highest data value and the sub-pixel component data value having the lowest data value.

16. The method according to claim 1, wherein the comparing step includes taking into account the sub-pixel color component data values for neighbouring pixels.

17. The method according to claim 1, wherein the modifying of the sub-pixel color component data values included in the pixel data is performed with respect to two or more of the plurality of sub-pixel color components.

18. The method according to claim 1, further comprising a step of processing the plurality of pixel data to provide privacy viewing with the LCD, wherein the sub-pixel color component data values included in the pixel data are modified in a public mode in order to reduce color shift when displayed on the LCD, and the sub-pixel color component data values included in the pixel data are modified in a private mode in order to provide privacy viewing.

19. The method according to claim 1, further comprising a step of filtering the plurality of pixel data to detect and modify a feature in the received image to avoid an undesirable display result otherwise caused by the modifying of the sub-pixel color component data values.

20. The method according to claim 1, wherein the sub-pixel color component data values included in the pixel data are modified differently based on particular color component.

21. The method according to claim 1, wherein the modifying step further includes altering a manner in which the modified sub-pixel color component data values are presented on the LCD to maintain dc balancing.

22. The method according to claim 8, wherein the lookup table is populated with output pixel data for each of the plurality of groups of input pixel data, the step of populating comprising determining a set of available on-axis/off-axis luminance points for the display device, considering a line or lines covering the full range of on-axis luminance values and having different respective off-axis luminance characteristics, and selecting a plurality of the available luminance points along each of the lines, the selection being made to reduce an error function which depends at least in part on a distance between the point and the line concerned, and populating the lookup table based on the pixel data required to produce the selected luminance points.

23. An apparatus for reducing color shift in relation to viewing angle in an LCD, comprising:

an input for receiving a plurality of pixel data constituting an image, each pixel data including a plurality of sub-pixel color components having respective data values;

a comparison section which, for each of the pixel data, compares the sub-pixel color component data values included therein; and a modifying section which, based on the comparison, modifies the sub-pixel color component data values included in the pixel data, said modification altering a combined off-axis luminance resulting from a group of pixels and leaving an on-axis luminance resulting from the group of pixels substantially unchanged.

24. The apparatus according to claim 23, wherein the modifying section maps each data value of at least one of the sub-pixel color components into at least two modified data values which are displayed on the LCD in multiplexed manner, and which exhibit a combined luminance to an on-axis viewer that is equal or proportional to that of the at least one of the sub-pixel color component data value.

25. A computer program stored on a non-transitory computer-readable medium which, when executed by a computer, carries out a method for reducing color shift in relation to viewing angle in an LCD, the method comprising:

receiving a plurality of pixel data constituting an image, each pixel data including a plurality of sub-pixel color components having respective data values;

for each of the pixel data, comparing the sub-pixel color component data values included therein; and based on the comparison, modifying the sub-pixel color component data values included in the pixel data, said modification altering a combined off-axis luminance resulting from a group of pixels, leaving an on-axis luminance resulting from the group of pixels substantially unchanged.

26. The computer program according to claim 25, wherein the modifying step includes mapping each data value of at least one of the sub-pixel color components into at least two modified data values which are displayed on the LCD in multiplexed manner, and which exhibit a combined luminance to an on-axis viewer that is equal or proportional to that of the at least one of the sub-pixel color component data value.

* * * * *